US011202161B2

(12) United States Patent
Copt. et al.

(10) Patent No.: US 11,202,161 B2
(45) Date of Patent: Dec. 14, 2021

(54) SYSTEM, METHOD, AND APPARATUS FOR GENERATING AND DIGITALLY PROCESSING A HEAD RELATED AUDIO TRANSFER FUNCTION

(71) Applicant: BONGIOVI ACOUSTICS LLC, Port St. Lucie, FL (US)

(72) Inventors: Ryan J. Copt., Port St. Lucie, FL (US); Joseph G. Butera, III, Stuart, FL (US); Robert J. Summers, III, Port St. Lucie, FL (US); Mark Harpster, Port St. Lucie, FL (US); David Lopez, Jr., Port St. Lucie, FL (US)

(73) Assignee: BONGIOVI ACOUSTICS LLC, Port St. Lucie, FL (US)

( * ) Notice: Subject to any disclaimer, the term of this patent is extended or adjusted under 35 U.S.C. 154(b) by 0 days.

(21) Appl. No.: 16/917,001

(22) Filed: Jun. 30, 2020

(65) Prior Publication Data

US 2020/0404441 A1 Dec. 24, 2020

Related U.S. Application Data

(63) Continuation-in-part of application No. 15/864,190, filed on Jan. 8, 2018, now Pat. No. 10,701,505, which (Continued)

(51) Int. Cl.
*H04R 5/02* (2006.01)
*H04S 7/00* (2006.01)

(Continued)

(52) U.S. Cl.
CPC ..... *H04S 7/302* (2013.01); *H04R 1/1075* (2013.01); *H04R 1/342* (2013.01); *H04R 5/027* (2013.01);

(Continued)

(58) Field of Classification Search
CPC ... H04S 7/302; H04S 2420/01; H04R 1/1016; H04R 5/027

(Continued)

(56) References Cited

U.S. PATENT DOCUMENTS 2,643,729 A 6/1953 McCracken
3,430,007 A 2/1969 Thielen (Continued)

FOREIGN PATENT DOCUMENTS

CA 2533221 6/1995
CA 2161412 4/2000

(Continued)

OTHER PUBLICATIONS

Jeffs et al., Dynamics Processors—Technology & Applications Tips, Rane Note 155, Rane Corporation, Sep. 2005, pp. 1-28, Sep. 1, 2005.

(Continued)

*Primary Examiner* — Katherine A Faley
(74) *Attorney, Agent, or Firm* — Malloy & Malloy, PL

(57) ABSTRACT

The present invention provides for an apparatus, system, and method for generating a head related audio transfer function in real time. Specifically, the present invention utilizes unique structural components including a tragus structure and an antihelix structure in connection with a microphone in order to communicate the location of a sound in three-dimensional space to a user. The invention also utilizes an audio processor to digitally process the head related audio transfer function.

21 Claims, 17 Drawing Sheets

Related U.S. Application Data is a continuation-in-part of application No. 15/478,696, filed on Apr. 4, 2017, now abandoned, which is a continuation of application No. 14/485,145, filed on Sep. 12, 2014, now Pat. No. 9,615,189, said application No. 15/864,190 is a continuation-in-part of application No. 15/163,353, filed on May 24, 2016, now Pat. No. 10,069,471, which is a continuation-in-part of application No. 14/059,948, filed on Oct. 22, 2013, now Pat. No. 9,348,904, which is a continuation-in-part of application No. 12/648,007, filed on Dec. 28, 2009, now Pat. No. 8,565,449, which is a continuation-in-part of application No. 11/947,301, filed on Nov. 29, 2007, now Pat. No. 8,160,274, which is a continuation-in-part of application No. 11/703,216, filed on Feb. 7, 2007, now abandoned.

(60) Provisional application No. 62/948,409, filed on Dec. 16, 2019, provisional application No. 62/035,025, filed on Aug. 8, 2014, provisional application No. 60/861,711, filed on Nov. 30, 2006, provisional application No. 60/765,722, filed on Feb. 7, 2006.

(51) Int. Cl.

| | |
|---|---|
| *H04R 1/10* | (2006.01) |
| *H04R 1/34* | (2006.01) |
| *H04R 5/027* | (2006.01) |
| *H04S 1/00* | (2006.01) |
| *H04R 5/033* | (2006.01) |

(52) U.S. Cl.
CPC ..... *H04R 5/033* (2013.01); *H04R 2201/107* (2013.01); *H04R 2205/022* (2013.01); *H04S 1/007* (2013.01); *H04S 2400/01* (2013.01); *H04S 2420/01* (2013.01)

(58) Field of Classification Search
USPC ..... 381/310, 311, 26, 380
See application file for complete search history.

(56) References Cited

U.S. PATENT DOCUMENTS

| | | | |
|---|---|---|---|
| 3,795,876 | A | 3/1974 | Takahashi et al. |
| 3,813,687 | A | 5/1974 | Geil |
| 4,162,462 | A | 7/1979 | Endoh et al. |
| 4,184,047 | A | 1/1980 | Langford |
| 4,218,950 | A | 8/1980 | Uetrecht |
| 4,226,533 | A | 10/1980 | Snowman |
| 4,257,325 | A | 3/1981 | Bertagni |
| 4,353,035 | A | 10/1982 | Schroder |
| 4,356,558 | A | 10/1982 | Owen et al. |
| 4,363,007 | A | 12/1982 | Haramoto et al. |
| 4,392,027 | A | 7/1983 | Bock |
| 4,399,474 | A | 8/1983 | Coleman, Jr. |
| 4,412,100 | A | 10/1983 | Orban |
| 4,458,362 | A | 7/1984 | Berkovitz et al. |
| 4,489,280 | A | 12/1984 | Bennett, Jr. et al. |
| 4,538,297 | A | 8/1985 | Waller, Jr. |
| 4,549,289 | A | 10/1985 | Schwartz et al. |
| 4,584,700 | A | 4/1986 | Scholz |
| 4,602,381 | A | 7/1986 | Cugnini et al. |
| 4,612,665 | A | 9/1986 | Inami et al. |
| 4,641,361 | A | 2/1987 | Rosback |
| 4,701,953 | A | 10/1987 | White |
| 4,704,726 | A | 11/1987 | Gibson |
| 4,715,559 | A | 12/1987 | Fuller |
| 4,739,514 | A | 4/1988 | Short et al. |
| 4,768,380 | A | 9/1988 | Vermeiren et al. |
| 4,815,142 | A | 3/1989 | Imreh |
| 4,856,068 | A | 8/1989 | Quatieri, Jr. et al. |
| 4,887,299 | A | 12/1989 | Cummins et al. |
| 4,997,058 | A | 3/1991 | Bertagni |
| 5,007,707 | A | 4/1991 | Bertagni |
| 5,073,936 | A | 12/1991 | Gorike et al. |
| 5,133,015 | A | 7/1992 | Scholz |
| 5,195,141 | A | 3/1993 | Jang |
| 5,210,704 | A | 5/1993 | Husseiny |
| 5,210,806 | A | 5/1993 | Kihara et al. |
| 5,226,076 | A | 7/1993 | Baumhauer, Jr. et al. |
| 5,355,417 | A | 10/1994 | Burdisso et al. |
| 5,361,381 | A | 11/1994 | Short |
| 5,384,856 | A | 1/1995 | Kyouno et al. |
| 5,420,929 | A | 5/1995 | Geddes et al. |
| 5,425,107 | A | 6/1995 | Bertagni et al. |
| 5,463,695 | A | 10/1995 | Werrbach |
| 5,465,421 | A | 11/1995 | McCormick et al. |
| 5,467,775 | A | 11/1995 | Callahan et al. |
| 5,473,214 | A | 12/1995 | Hildebrand |
| 5,511,129 | A | 4/1996 | Craven et al. |
| 5,515,444 | A | 5/1996 | Burdisso et al. |
| 5,539,835 | A | 7/1996 | Bertagni et al. |
| 5,541,866 | A | 7/1996 | Sato et al. |
| 5,572,443 | A | 11/1996 | Emoto et al. |
| 5,617,480 | A | 4/1997 | Ballard et al. |
| 5,615,275 | A | 5/1997 | Bertagni |
| 5,638,456 | A | 6/1997 | Conley et al. |
| 5,640,685 | A | 6/1997 | Komoda |
| 5,671,287 | A | 9/1997 | Gerzon |
| 5,693,917 | A | 12/1997 | Bertagni et al. |
| 5,699,438 | A | 12/1997 | Smith et al. |
| 5,727,074 | A | 3/1998 | Hildebrand |
| 5,737,432 | A | 4/1998 | Werrbach |
| 5,812,684 | A | 9/1998 | Mark |
| 5,828,768 | A | 10/1998 | Eatwell et al. |
| 5,832,097 | A | 11/1998 | Armstrong et al. |
| 5,838,805 | A | 11/1998 | Warnaka et al. |
| 5,848,164 | A | 12/1998 | Levine |
| 5,861,686 | A | 1/1999 | Lee |
| 5,862,461 | A | 1/1999 | Yoshizawa et al. |
| 5,872,852 | A | 2/1999 | Dougherty |
| 5,901,231 | A | 5/1999 | Parrella et al. |
| 5,990,955 | A | 11/1999 | Koz |
| 6,058,196 | A | 5/2000 | Heron |
| 6,078,670 | A | 6/2000 | Beyer |
| 6,093,144 | A | 7/2000 | Jaeger et al. |
| 6,108,431 | A | 8/2000 | Bachler |
| 6,195,438 | B1 | 2/2001 | Yumoto et al. |
| 6,201,873 | B1 | 3/2001 | Dal Farra |
| 6,202,601 | B1 | 3/2001 | Ouellette et al. |
| 6,208,237 | B1 | 3/2001 | Saiki et al. |
| 6,244,376 | B1 | 6/2001 | Granzotto |
| 6,263,354 | B1 | 7/2001 | Gandhi |
| 6,285,767 | B1 | 9/2001 | Klayman |
| 6,292,511 | B1 | 9/2001 | Goldston et al. |
| 6,317,117 | B1 | 11/2001 | Goff |
| 6,318,797 | B1 | 11/2001 | Bohm et al. |
| 6,332,029 | B1 | 12/2001 | Azima et al. |
| 6,343,127 | B1 | 1/2002 | Billoud |
| 6,484,845 | B1 | 11/2002 | Schleicher et al. |
| 6,518,852 | B1 | 2/2003 | Derrick |
| 6,529,611 | B2 | 3/2003 | Kobayashi et al. |
| 6,535,846 | B1 | 3/2003 | Shashoua |
| 6,570,993 | B1 | 5/2003 | Fukuyama |
| 6,587,564 | B1 | 7/2003 | Cusson |
| 6,618,487 | B1 | 9/2003 | Azima et al. |
| 6,661,897 | B2 | 12/2003 | Smith |
| 6,661,900 | B1 | 12/2003 | Allred et al. |
| 6,760,451 | B1 | 7/2004 | Craven et al. |
| 6,772,114 | B1 | 8/2004 | Sluijter et al. |
| 6,839,438 | B1 | 1/2005 | Riegelsberger et al. |
| 6,847,258 | B2 | 1/2005 | Ishida et al. |
| 6,871,525 | B2 | 3/2005 | Withnall et al. |
| 6,907,391 | B2 | 6/2005 | Bellora et al. |
| 6,999,826 | B1 | 2/2006 | Zhou et al. |
| 7,006,653 | B2 | 2/2006 | Guenther |
| 7,016,746 | B2 | 3/2006 | Wiser et al. |
| 7,024,001 | B1 | 4/2006 | Nakada |
| 7,058,463 | B1 | 6/2006 | Ruha et al. |
| 7,123,728 | B2 | 10/2006 | King et al. |
| 7,236,602 | B2 | 6/2007 | Gustavsson |

(56) References Cited

U.S. PATENT DOCUMENTS 7,254,243 B2 8/2007 Bongiovi
7,266,205 B2 9/2007 Miller
7,269,234 B2 9/2007 Klingenbrunn et al.
7,274,795 B2 9/2007 Bongiovi
7,430,300 B2 9/2008 Vosburgh et al.
7,519,189 B2 4/2009 Bongiovi
7,577,263 B2 8/2009 Tourwe
7,613,314 B2 11/2009 Camp, Jr.
7,676,048 B2 3/2010 Tsutsui
7,711,129 B2 5/2010 Lindahl et al.
7,711,442 B2 5/2010 Ryle et al.
7,747,447 B2 6/2010 Christensen et al.
7,764,802 B2 7/2010 Oliver
7,778,718 B2 8/2010 Janke et al.
7,916,876 B1 3/2011 Helsloot et al.
8,068,621 B2 11/2011 Okabayashi et al.
8,144,902 B2 3/2012 Johnston
8,160,274 B2 4/2012 Bongiovi
8,175,287 B2 5/2012 Ueno et al.
8,218,789 B2 7/2012 Bharitkar et al.
8,229,136 B2 7/2012 Bongiovi et al.
8,284,955 B2 10/2012 Bongiovi et al.
8,385,864 B2 2/2013 Dickson et al.
8,462,963 B2 6/2013 Bongiovi et al.
8,472,642 B2 6/2013 Bongiovi
8,503,701 B2 8/2013 Miles et al.
8,565,449 B2 10/2013 Bongiovi
8,577,676 B2 11/2013 Muesch
8,619,998 B2 12/2013 Walsh et al.
8,705,765 B2 4/2014 Bongiovi
8,750,538 B2 6/2014 Avendano et al.
8,811,630 B2 8/2014 Burlingame
8,879,743 B1 * 11/2014 Mitra ..... H04R 1/342
381/26
9,195,433 B2 11/2015 Bongiovi et al.
9,264,004 B2 2/2016 Bongiovi et al.
9,276,542 B2 3/2016 Bongiovi et al.
9,281,794 B1 3/2016 Bongiovi et al.
9,344,828 B2 5/2016 Bongiovi et al.
9,348,904 B2 5/2016 Bongiovi et al.
9,350,309 B2 5/2016 Bongiovi et al.
9,397,629 B2 7/2016 Bongiovi et al.
9,398,394 B2 7/2016 Bongiovi et al.
9,413,321 B2 8/2016 Bongiovi et al.
9,564,146 B2 2/2017 Bongiovi et al.
9,615,189 B2 4/2017 Copt et al.
9,621,994 B1 4/2017 Bongiovi et al.
9,638,672 B2 5/2017 Butera, III et al.
9,741,355 B2 8/2017 Bongiovi et al.
9,793,872 B2 10/2017 Bongiovi et al.
9,883,318 B2 1/2018 Bongiovi et al.
9,906,858 B2 2/2018 Bongiovi et al.
9,906,867 B2 2/2018 Bongiovi et al.
9,998,832 B2 6/2018 Bongiovi et al.
10,069,471 B2 9/2018 Bongiovi et al.
10,158,337 B2 12/2018 Bongiovi et al.
10,291,195 B2 5/2019 Bongiovi et al.
10,313,791 B2 6/2019 Bongiovi
10,412,533 B2 9/2019 Bongiovi et al.
10,666,216 B2 5/2020 Bongiovi et al.
10,701,505 B2 6/2020 Copt et al.
10,959,035 B2 3/2021 Butera, III et al.
10,999,695 B2 5/2021 Bongiovi et al.
2001/0008535 A1 7/2001 Lanigan
2001/0043704 A1 11/2001 Schwartz
2001/0046304 A1 11/2001 Rast
2002/0057808 A1 5/2002 Goldstein
2002/0071481 A1 6/2002 Goodings
2002/0094096 A1 7/2002 Paritsky et al.
2003/0016838 A1 1/2003 Paritsky et al.
2003/0023429 A1 1/2003 Claesson et al.
2003/0035555 A1 2/2003 King et al.
2003/0043940 A1 3/2003 Janky et al.
2003/0112088 A1 6/2003 Bizjak
2003/0138117 A1 7/2003 Goff
2003/0164546 A1 9/2003 Giger
2003/0179891 A1 9/2003 Rabinowitz et al.
2003/0216907 A1 11/2003 Thomas
2004/0005063 A1 1/2004 Klayman
2004/0008851 A1 1/2004 Hagiwara
2004/0022400 A1 2/2004 Magrath
2004/0042625 A1 3/2004 Brown
2004/0044804 A1 3/2004 MacFarlane
2004/0086144 A1 5/2004 Kallen
2004/0103588 A1 6/2004 Allaei
2004/0138769 A1 7/2004 Akiho
2004/0146170 A1 7/2004 Zint
2004/0189264 A1 9/2004 Matsuura et al.
2004/0208646 A1 10/2004 Choudhary et al.
2005/0013453 A1 1/2005 Cheung
2005/0090295 A1 4/2005 Ali et al.
2005/0117771 A1 6/2005 Vosburgh et al.
2005/0129248 A1 6/2005 Kraemer et al.
2005/0175185 A1 8/2005 Korner
2005/0201572 A1 9/2005 Lindahl et al.
2005/0249272 A1 11/2005 Kirkeby et al.
2005/0254564 A1 11/2005 Tsutsui
2006/0034467 A1 2/2006 Sleboda et al.
2006/0045294 A1 3/2006 Smyth
2006/0064301 A1 3/2006 Aguilar et al.
2006/0098827 A1 5/2006 Paddock et al.
2006/0115107 A1 6/2006 Vincent et al.
2006/0126851 A1 6/2006 Yuen et al.
2006/0126865 A1 6/2006 Blamey et al.
2006/0138285 A1 6/2006 Oleski et al.
2006/0140319 A1 6/2006 Eldredge et al.
2006/0153281 A1 7/2006 Karlsson
2006/0189841 A1 8/2006 Pluvinage
2006/0291670 A1 12/2006 King et al.
2007/0010132 A1 1/2007 Nelson et al.
2007/0030994 A1 2/2007 Ando et al.
2007/0056376 A1 3/2007 King
2007/0106179 A1 5/2007 Bagha et al.
2007/0119421 A1 5/2007 Lewis et al.
2007/0150267 A1 6/2007 Honma et al.
2007/0173990 A1 7/2007 Smith et al.
2007/0177459 A1 8/2007 Behn et al.
2007/0206643 A1 9/2007 Egan et al.
2007/0223713 A1 9/2007 Gunness
2007/0223717 A1 9/2007 Boersma
2007/0253577 A1 11/2007 Yen et al.
2008/0031462 A1 2/2008 Walsh et al.
2008/0040116 A1 2/2008 Cronin et al.
2008/0049948 A1 2/2008 Christoph et al.
2008/0069385 A1 3/2008 Revit
2008/0123870 A1 5/2008 Stark et al.
2008/0123873 A1 5/2008 Bjorn-Josefsen et al.
2008/0165989 A1 7/2008 Seil et al.
2008/0181424 A1 7/2008 Schulein et al.
2008/0212798 A1 9/2008 Zartarian
2008/0255855 A1 10/2008 Lee et al.
2009/0022328 A1 1/2009 Neugebauer et al.
2009/0054109 A1 2/2009 Hunt
2009/0080675 A1 3/2009 Smirnov et al.
2009/0086996 A1 4/2009 Bongiovi et al.
2009/0116652 A1 5/2009 Kirkeby et al.
2009/0282810 A1 11/2009 Leone et al.
2009/0290725 A1 11/2009 Huang
2009/0296959 A1 12/2009 Bongiovi
2010/0045374 A1 2/2010 Wu et al.
2010/0246832 A1 9/2010 Villemoes et al.
2010/0252677 A1 10/2010 Petitjean
2010/0256843 A1 10/2010 Bergstein et al.
2010/0278364 A1 11/2010 Berg
2010/0303278 A1 12/2010 Sahyoun
2011/0002467 A1 1/2011 Nielsen
2011/0007907 A1 1/2011 Park et al.
2011/0013736 A1 1/2011 Tsukamoto et al.
2011/0065408 A1 3/2011 Kenington et al.
2011/0087346 A1 4/2011 Larsen et al.
2011/0096936 A1 4/2011 Gass
2011/0125063 A1 5/2011 Shalon et al.
2011/0194712 A1 8/2011 Potard
2011/0230137 A1 9/2011 Hicks et al.

(56) References Cited

U.S. PATENT DOCUMENTS

| | | | |
|---|---|---|---|
| 2011/0257833 | A1 | 10/2011 | Trush et al. |
| 2011/0280411 | A1 | 11/2011 | Cheah et al. |
| 2012/0008798 | A1 | 1/2012 | Ong |
| 2012/0014553 | A1 | 1/2012 | Bonanno |
| 2012/0020502 | A1 | 1/2012 | Adams |
| 2012/0022842 | A1 | 1/2012 | Amadu |
| 2012/0063611 | A1 | 3/2012 | Kimura |
| 2012/0089045 | A1 | 4/2012 | Seidl et al. |
| 2012/0099741 | A1 | 4/2012 | Gotoh et al. |
| 2012/0170759 | A1 | 7/2012 | Yuen et al. |
| 2012/0170795 | A1 | 7/2012 | Sancisi et al. |
| 2012/0189131 | A1 | 7/2012 | Ueno et al. |
| 2012/0213034 | A1 | 8/2012 | Imran |
| 2012/0213375 | A1 | 8/2012 | Mahabub et al. |
| 2012/0300949 | A1 | 11/2012 | Rauhala et al. |
| 2012/0302920 | A1 | 11/2012 | Bridger et al. |
| 2013/0083958 | A1 | 4/2013 | Katz et al. |
| 2013/0089225 | A1* | 4/2013 | Tsai ..... H04R 1/1075 381/309 |
| 2013/0129106 | A1 | 5/2013 | Sapiejewski |
| 2013/0163767 | A1 | 6/2013 | Gauger, Jr. et al. |
| 2013/0163783 | A1 | 6/2013 | Burlingame |
| 2013/0169779 | A1 | 7/2013 | Pedersen |
| 2013/0220274 | A1 | 8/2013 | Deshpande et al. |
| 2013/0227631 | A1 | 8/2013 | Sharma et al. |
| 2013/0242191 | A1 | 9/2013 | Leyendecker et al. |
| 2013/0251175 | A1 | 9/2013 | Bongiovi et al. |
| 2013/0277631 | A1 | 10/2013 | Luntz et al. |
| 2013/0288596 | A1 | 10/2013 | Suzuki et al. |
| 2013/0338504 | A1 | 12/2013 | Demos et al. |
| 2013/0343564 | A1 | 12/2013 | Darlington |
| 2014/0067236 | A1 | 3/2014 | Henry et al. |
| 2014/0119583 | A1 | 5/2014 | Valentine et al. |
| 2014/0126734 | A1 | 5/2014 | Gauger, Jr. et al. |
| 2014/0257714 | A1 | 9/2014 | Kiviniemi et al. |
| 2014/0261301 | A1 | 9/2014 | Leone |
| 2014/0379355 | A1 | 12/2014 | Hosokawsa |
| 2015/0039250 | A1 | 2/2015 | Rank |
| 2015/0194158 | A1 | 7/2015 | Oh et al. |
| 2015/0208163 | A1 | 7/2015 | Hallberg et al. |
| 2015/0215720 | A1 | 7/2015 | Carroll |
| 2016/0209831 | A1 | 7/2016 | Pal |
| 2017/0072305 | A1 | 3/2017 | Watanabe |
| 2017/0188989 | A1 | 7/2017 | Copt et al. |
| 2017/0193980 | A1 | 7/2017 | Bongiovi et al. |
| 2017/0208380 | A1 | 7/2017 | Slater |
| 2017/0241422 | A1 | 8/2017 | Munk et al. |
| 2017/0272887 | A1 | 9/2017 | Copt et al. |
| 2017/0345408 | A1 | 11/2017 | Hong et al. |
| 2018/0077482 | A1 | 3/2018 | Yuan |
| 2018/0091109 | A1 | 3/2018 | Bongiovi et al. |
| 2018/0102133 | A1 | 4/2018 | Bongiovi et al. |
| 2018/0139565 | A1 | 5/2018 | Norris et al. |
| 2018/0226064 | A1 | 8/2018 | Seagriff et al. |
| 2019/0020950 | A1 | 1/2019 | Bongiovi et al. |
| 2019/0069114 | A1 | 2/2019 | Tai et al. |
| 2019/0075388 | A1 | 3/2019 | Schrader et al. |
| 2019/0318719 | A1 | 10/2019 | Copt et al. |
| 2019/0387340 | A1 | 12/2019 | Audfray et al. |
| 2020/0007983 | A1 | 1/2020 | Bongiovi et al. |
| 2020/0053503 | A1 | 2/2020 | Butera, III et al. |
| 2021/0152937 | A1 | 5/2021 | Bongiovi et al. |
| 2021/0257983 | A1 | 8/2021 | Bongiovi et al. |

FOREIGN PATENT DOCUMENTS

| | | |
|---|---|---|
| CA | 2854086 | 12/2018 |
| CN | 1173268 | 2/1998 |
| CN | 1243653 | 2/2000 |
| CN | 1910816 | 2/2007 |
| CN | 101720557 | 6/2010 |
| CN | 102498729 | 6/2012 |
| CN | 103004237 | 3/2013 |
| CN | 103141121 | 6/2013 |
| CN | 203057339 | 7/2013 |
| CN | 103250209 | 8/2013 |
| CN | 103455824 | 12/2013 |
| EP | 0206746 | 8/1992 |
| EP | 0541646 | 1/1995 |
| EP | 0580579 | 6/1998 |
| EP | 0698298 | 2/2000 |
| EP | 0932523 | 6/2000 |
| EP | 0666012 | 11/2002 |
| EP | 2814267 | 2/2016 |
| GB | 2003707 | 3/1979 |
| GB | 2320393 | 6/1998 |
| JP | 2001509985 | 7/2001 |
| JP | 2005500768 | 1/2005 |
| TW | 201404185 | 1/2014 |
| WO | WO9219080 | 10/1992 |
| WO | WO1993011637 | 6/1993 |
| WO | WO9531805 | 11/1995 |
| WO | WO9535628 | 12/1995 |
| WO | WO9601547 | 1/1996 |
| WO | WO9611465 | 4/1996 |
| WO | WO9709698 | 3/1997 |
| WO | WO9709840 | 3/1997 |
| WO | WO9709841 | 3/1997 |
| WO | WO9709842 | 3/1997 |
| WO | WO9709843 | 3/1997 |
| WO | WO9709844 | 3/1997 |
| WO | WO9709845 | 3/1997 |
| WO | WO9709846 | 3/1997 |
| WO | WO9709847 | 3/1997 |
| WO | WO9709848 | 3/1997 |
| WO | WO9709849 | 3/1997 |
| WO | WO9709852 | 3/1997 |
| WO | WO9709853 | 3/1997 |
| WO | WO9709854 | 3/1997 |
| WO | WO9709855 | 3/1997 |
| WO | WO9709856 | 3/1997 |
| WO | WO9709857 | 3/1997 |
| WO | WO9709858 | 3/1997 |
| WO | WO9709859 | 3/1997 |
| WO | WO9709861 | 3/1997 |
| WO | WO9709862 | 3/1997 |
| WO | WO9717818 | 5/1997 |
| WO | WO9717820 | 5/1997 |
| WO | WO9813942 | 4/1998 |
| WO | WO9816409 | 4/1998 |
| WO | WO9828942 | 7/1998 |
| WO | WO9831188 | 7/1998 |
| WO | WO9834320 | 8/1998 |
| WO | WO9839947 | 9/1998 |
| WO | WO9842536 | 10/1998 |
| WO | WO9843464 | 10/1998 |
| WO | WO9852381 | 10/1998 |
| WO | WO9852383 | 11/1998 |
| WO | WO9853638 | 11/1998 |
| WO | WO9902012 | 1/1999 |
| WO | WO9908479 | 2/1999 |
| WO | WO9911490 | 3/1999 |
| WO | WO9912387 | 3/1999 |
| WO | WO9913684 | 3/1999 |
| WO | WO9921397 | 4/1999 |
| WO | WO9935636 | 7/1999 |
| WO | WO9935883 | 7/1999 |
| WO | WO9937121 | 7/1999 |
| WO | WO9938155 | 7/1999 |
| WO | WO9941939 | 8/1999 |
| WO | WO9952322 | 10/1999 |
| WO | WO9952324 | 10/1999 |
| WO | WO9956497 | 11/1999 |
| WO | WO9962294 | 12/1999 |
| WO | WO9965274 | 12/1999 |
| WO | WO0002417 | 1/2000 |
| WO | WO0007408 | 2/2000 |
| WO | WO0007409 | 2/2000 |
| WO | WO0013464 | 3/2000 |
| WO | WO0015003 | 3/2000 |
| WO | WO0033612 | 6/2000 |
| WO | WO0033613 | 6/2000 |
| WO | WO03104924 | 12/2003 |

(56) References Cited

FOREIGN PATENT DOCUMENTS

| | | |
|---|---|---|
| WO | WO2006020427 | 2/2006 |
| WO | WO2007092420 | 8/2007 |
| WO | WO2008067454 | 6/2008 |
| WO | WO2009070797 | 6/2009 |
| WO | WO2009102750 | 8/2009 |
| WO | WO2009114746 | 9/2009 |
| WO | WO2009155057 | 12/2009 |
| WO | WO2010027705 | 3/2010 |
| WO | WO2010051354 | 5/2010 |
| WO | WO2010138311 | 12/2010 |
| WO | WO2011081965 | 7/2011 |
| WO | WO2012134399 | 10/2012 |
| WO | WO2012154823 | 11/2012 |
| WO | WO2013055394 | 4/2013 |
| WO | WO2013076223 | 5/2013 |
| WO | WO2014201103 | 12/2014 |
| WO | WO2015061393 | 4/2015 |
| WO | WO2015077681 | 5/2015 |
| WO | WO2016019263 | 2/2016 |
| WO | WO2016022422 | 2/2016 |
| WO | WO2016144861 | 9/2016 |
| WO | WO2019051075 | 3/2019 |
| WO | WO 2019200119 | 10/2019 |
| WO | WO2021126981 | 6/2021 |

OTHER PUBLICATIONS

Novasound Int., http://www.novasoundint.com/new_page_t.htm, 2004, Jan. 1, 2004.

* cited by examiner

SYSTEM, METHOD, AND APPARATUS FOR GENERATING AND DIGITALLY PROCESSING A HEAD RELATED AUDIO TRANSFER FUNCTION

CLAIM OF PRIORITY

The present invention is a continuation-in-part of a previously filed, now pending application having Ser. No. 15/864,190 and a filing date of Jan. 8, 2018, which is a continuation-in-part of a previously filed application having Ser. No. 15/478,696 and a filing date of Apr. 4, 2017, which is a continuation application of a previously filed application having Ser. No. 14/485,145 and a filing date of Sep. 12, 2014, which matured into U.S. Pat. No. 9,615,189, and which is based on, and a claim of priority was made under 35 U.S.C. Section 119(e), to a provisional patent application having Ser. No. 62/035,025 and a filing date of Aug. 8, 2014, all of which are explicitly incorporated herein by reference, in their entireties. The previously filed, now pending application having Ser. No. 15/864,190, and a filing date of Jan. 8, 2018, is also a continuation-in-part of a previously filed application having Ser. No. 15/163,353 and a filing date of May 24, 2016, which matured into U.S. Pat. No. 10,069,471, and which is a continuation-in-part of Ser. No. 14/059,948, which matured into U.S. Pat. No. 9,348,904, and which is a continuation-in-part of Ser. No. 12/648,007 filed on Dec. 28, 2009, which matured into U.S. Pat. No. 8,565,449, and which is a continuation-in-part of Ser. No. 11/947,301, filed Nov. 29, 2007, which matured into U.S. Pat. No. 8,160,274, and which claims priority to U.S. Provisional Application No. 60/861,711 filed Nov. 30, 2006, each which are explicitly incorporated herein by reference, in there entireties. Further, Ser. No. 11/947,301 is a continuation-in-part of Ser. No. 11/703,216, filed Feb. 7, 2007, and which claims priority to U.S. Provisional Application No. 60/765,722 filed Feb. 7, 2006, each which are explicitly incorporated herein by reference, in their entireties.

The present invention also claims priority to U.S. Provisional Application No. 62/948,409 filed on Dec. 16, 2019, which is explicitly incorporated herein by reference, in its entirety.

FIELD OF THE INVENTION

The present invention provides for a system and apparatus for generating a real time head related audio transfer function. Specifically, unique structural components are utilized in connection with a microphone to reproduce certain acoustic characteristics of the human pinna in order to facilitate the communication of the location of a sound in three dimensional space to a user. The invention may further utilize an audio processor to digitally process the head related audio transfer function.

BACKGROUND OF THE INVENTION

Human beings have just two ears, but can locate sounds in three dimensions, in distance and in direction. This is possible because the brain, the inner ears, and the external ears (pinna) work together to make inferences about the location of a sound. The location of a sound is estimated by taking cues derived from one ear (monoaural cues), as well as by comparing the difference between the cues received in both ears (binaural cues).

Binaural cues relate to the differences of arrival and intensity of the sound between the two ears, which assist with the relative localization of a sound source. Monoaural cues relate to the interaction between the sound source and the human anatomy, in which the original sound is modified by the external ear before it enters the ear canal for processing by the auditory system. The modifications encode the source location relative to the ear location and are known as head-related transfer functions (HRTF).

In other words, HRTFs describe the filtering of a sound source before it is perceived at the left and right ear drums, in order to characterize how a particular ear receives sound from a particular point in space. These modifications may include the shape of the listener's ear, the shape of the listener's head and body, the acoustical characteristics of the space in which the sound is played, and so forth. All these characteristics together influence how a listener can accurately tell what direction a sound is coming from. Thus, a pair of HRTFs accounting for all these characteristics, generated by the two ears, can be used to synthesize a binaural sound and accurately recognize it as originating from a particular point in space.

HRTFs have wide ranging applications, from virtual surround sound in media and gaming, to hearing protection in loud noise environments, and hearing assistance for the hearing impaired. Particularly, in fields hearing protection and hearing assistance, the ability to record and reconstruct a particular user's HRTF presents several challenges as it must occur in real time. In the case of an application for hearing protection in high noise environments, heavy hearing protection hardware must be worn over the ears in the form of bulky headphones, thus, if microphones are placed on the outside of the headphones, the user will hear the outside world but will not receive accurate positional data because the HRTF is not being reconstructed. Similarly, in the case of hearing assistance for the hearing impaired, a microphone is similarly mounted external to the hearing aid, and any hearing aid device that fully blocks a user's ear canal will not accurately reproduce that user's HRTF.

Thus, there is a need for an apparatus and system for reconstructing a user's HRTF in accordance to the user's physical characteristics, in order to accurately relay positional sound information to the user in real time.

SUMMARY OF THE INVENTION

The present invention meets the existing needs described above by providing for an apparatus, system, and method for generating a head related audio transfer function. The present invention also provides for the ability to enhance audio in real-time and tailors the enhancement to the physical characteristics of a user and the acoustic characteristics of the external environment.

Accordingly, in initially broad terms, an apparatus directed to the present invention, also known as an HRTF generator, comprises an external manifold and internal manifold. The external manifold is exposed at least partially to an external environment, while the internal manifold is disposed substantially within an interior of the apparatus and/or a larger device or system housing said apparatus.

The external manifold comprises an antihelix structure, a tragus structure, and an opening. The opening is in direct air flow communication with the outside environment, and is structured to receive acoustic waves. The tragus structure is disposed to partially enclose the opening, such that the tragus structure will partially impede and/or affect the characteristics of the incoming acoustic waves going into the opening. The antihelix structure is disposed to further partially enclose the tragus structure as well as the opening, such that the antihelix structure will partially impede and/or affect the characteristics of the incoming acoustic waves flowing onto the tragus structure and into the opening. The antihelix and tragus structures may comprise partial domes or any variation of partial-domes comprising a closed side and an open side. In a preferred embodiment, the open side of the antihelix structure and the open side of the tragus structure are disposed in confronting relation to one another.

The opening of the external manifold is connected to and in air flow communication with an opening canal inside the external manifold. The opening canal may be disposed in a substantially perpendicular orientation relative to the desired orientation of the user. The opening canal is in further air flow communication with an auditory canal, which is formed within the internal manifold but also be formed partially in the external manifold.

The internal manifold comprises the auditory canal and a microphone housing. The microphone housing is attached or connected to an end of the auditory canal on the opposite end to its connection with the opening canal. The auditory canal, or at least the portion of the portion of the auditory canal, may be disposed in a substantially parallel orientation relative to the desired listening direction of the user. The microphone housing may further comprise a microphone mounted against the end of the auditory canal. The microphone housing may further comprise an air cavity behind the microphone on an end opposite its connection to the auditory canal, which may be sealed with a cap.

In at least one embodiment, the apparatus or HRTF generator may form a part of a larger system. Accordingly, the system may comprise a left HRTF generator, a right HRTF generator, a left preamplifier, a right preamplifier, an audio processor, a left playback module, and a right playback module.

As such, the left HRTF generator may be structured to pick up and filter sounds to the left of a user. Similarly, the right HRTF generator may be structured to pick up and filter sounds to the right of the user. A left preamplifier may be structured and configured to increase the gain of the filtered sound of the left HRTF generator. A right preamplifier may be structured and configured to increase the gain of the filtered sound of the right HRTF generator. The audio processor may be structured and configured to process and enhance the audio signal received from the left and right preamplifiers, and then transmit the respective processed signals to each of the left and right playback modules. The left and right playback modules or transducers are structured and configured to convert the electrical signals into sound to the user, such that the user can then perceive the filtered and enhanced sound from the user's environment, which includes audio data that allows the user to localize the source of the originating sound.

In at least one embodiment, the system of the present invention may comprise a wearable device such as a headset or headphones having the HRTF generator embedded therein. The wearable device may further comprise the preamplifiers, audio processor, and playback modules, as well as other appropriate circuitry and components.

In a further embodiment, a method for generating a head related audio transfer function may be used in accordance with the present invention. As such, external sound is first filtered through an exterior of an HRTF generator which may comprise a tragus structure and an antihelix structure. The filtered sound is then passed to the interior of the HRTF generator, such as through the opening canal and auditory canal described above to create an input sound. The input sound is received at a microphone embedded within the HRTF generator adjacent to and connected to the auditory canal in order to create an input signal. The input signal is amplified with a preamplifier in order to create an amplified signal. The amplified signal is then processed with an audio processor, in order to create a processed signal. Finally, the processed signal is transmitted to the playback module in order to relay audio and/or locational audio data to a user.

In certain embodiments, the audio processor may receive the amplified signal and first filter the amplified signal with a high pass filter. The high pass filter, in at least one embodiment, is configured to remove ultra-low frequency content from the amplified signal resulting in the generation of a high pass signal.

The high pass signal from the high pass filter is then filtered through a first filter module to create a first filtered signal. The first filter module is configured to selectively boost and/or attenuate the gain of select frequency ranges in an audio signal, such as the high pass signal. In at least one embodiment, the first filter module boosts frequencies above a first frequency, and attenuates frequencies below a first frequency.

The first filtered signal from the first filter module is then modulated with a first compressor to create a modulated signal. The first compressor is configured for the dynamic range compression of a signal, such as the first filtered signal. Because the first filtered signal boosted higher frequencies and attenuated lower frequencies, the first compressor may, in at least one embodiment, be configured to trigger and adjust the higher frequency material, while remaining relatively insensitive to lower frequency material.

The modulated signal from the first compressor is then filtered through a second filter module to create a second filtered signal. The second filter module is configured to selectively boost and/or attenuate the gain of select frequency ranges in an audio signal, such as the modulated signal. In at least one embodiment, the second filter module is configured to be of least partially inverse relation relative to the first filter module. For example, if the first filter module boosted content above a first frequency by +X dB and attenuated content below a first frequency by −Y dB, the second filter module may then attenuate the content above the first frequency by −X dB, and boost the content below the first frequency by +Y dB. In other words, the purpose of the second filter module in one embodiment may be to "undo" the gain adjustment that was applied by the first filter module.

The second filtered signal from the second filter module is then processed with a first processing module to create a processed signal. In at least one embodiment, the first processing module may comprise a peak/dip module. In other embodiments, the first processing module may comprise both a peak/dip module and a first gain element. The first gain element may be configured to adjust the gain of the signal, such as the second filtered signal. The peak/dip module may be configured to shape the signal, such as to increase or decrease overshoots or undershoots in the signal.

The processed signal from the first processing module is then split with a band splitter into a low band signal, a mid band signal and a high band signal. In at least one embodiment, each band may comprise the output of a fourth order section, which may be realized as the cascade of second order biquad filters.

The low band signal is modulated with a low band compressor to create a modulated low band signal, and the high band signal is modulated with a high band compressor to create a modulated high band signal. The low band compressor and high band compressor are each configured to dynamically adjust the gain of a signal. Each of the low band compressor and high band compressor may be computationally and/or configured identically as the first compressor.

The modulated low band signal, the mid band signal, and the modulated high band signal are then processed with a second processing module. The second processing module may comprise a summing module configured to combine the signals. The summing module in at least one embodiment may individually alter the gain of each of the modulated low band, mid band, and modulated high band signals. The second processing module may further comprise a second gain element. The second gain element may adjust the gain of the combined signal in order to create a processed signal that is transmitted to the playback module.

The method described herein may be configured to capture and transmit locational audio data to a user in real time, such that it can be utilized as a hearing aid, or in loud noise environments to filter out loud noises.

In a further embodiment for generating a head related audio transfer function, the HRTF generator, rather than being embedded in a wearable device, may actually be configured as the wearable device itself. In the preferred embodiment, the HRTF generator will be configured into at least one, but most preferably two, in-ear assembly apparatus(es). The at least one in-ear assembly is operatively positioned, or in an operative position, when it is disposed on a user's ear, or worn by a user.

The in-ear assembly may comprise at least one shell or chamber to house the various HRTF structures, and provide an exterior surface to place or attach structures on the outside. The in-ear assembly may comprise a primary chamber proximal to a user's ear(s) and a secondary chamber distal to a user's ear(s), when in an operative position.

The exterior of the in-ear assembly's secondary chamber comprises a windscreen structure, an antihelix structure, a tragus structure, and a microphone opening or aperture. The windscreen structure, antihelix structure, and tragus structures can be removed from the exterior of the secondary chamber, providing a means of replacing the structures. Also, the windscreen structure, antihelix structure, and tragus structures may vary in size and shape.

One of the many purposes of the windscreen structure is to reduce wind and noise interference to ensure the in-ear assembly receives high-quality and undisturbed sound and audio signals from the external environment. The windscreen structure can attach to the exterior of the secondary chamber via at least one connecting point. A variety of materials may be utilized, but in a preferred embodiment open cell foam is housed within the windscreen structure to ensure the quality of the incoming signals. The windscreen structure and the material housed inside the windscreen structure will partially cover the antihelix structure, the tragus structure, and the microphone opening or aperture. The antihelix structure and the tragus structure can also cover, partially or fully, the microphone aperture in order to mimic the structure of a human ear. The microphone aperture is in direct air flow communication with the external environment via an opening and microphone channel. The microphone may be attached to an end of the microphone channel. In this way, the microphone will receive the external noise that filters through the windscreen structure, the antihelix structure, tragus structure, microphone aperture, and microphone channel, ensuring that the audio signal produced by the HRTF Generator will include the "directionality" that occurs when a human ear detects sound from a point in space.

The microphone disposed within the end of the microphone channel is located inside the in-ear assembly, and may be located within the secondary or primary chamber of a preferred embodiment of the in-ear assembly. The microphone channel and the microphone may be in a substantially parallel orientation, or alternatively, perpendicular orientation, relative to the listening direction of a user when wearing the in-ear assembly. The microphone is located adjacent to, or even directly connected to, a playback module, or one or more speakers or transducers, which transmits audio input signals to the playback module, and in turn the playback module transmits an audio output signal to a user via an auditory channel connected to a user's ear. In a preferred embodiment, the in-ear assembly will also comprise a preamplifier to amplify an audio input signal received from the microphone, and an audio processor to receive the amplified signal for processing. The audio processor will then transmit a processed, higher quality signal to the playback module. The playback module may be housed, and there may also be speaker drivers. The playback module may be mounted flush on an end of the auditory channel, or there may be an air cavity between the playback module and the end of the auditory channel. The auditory channel is disposed within the user's ear when the in-ear assembly is in an operative position, and a foam ear tip or other material may be attached to the end of the auditory channel to protect a user's ear(s) as well as insulate the user's ear(s) from ambient noise. The speaker(s) or playback module(s) is located inside the in-ear assembly, and in one embodiment, the playback module is located in the primary chamber of the in-ear assembly.

The microphone that receives audio input from the external environment and the playback module that sends audio output to the user are isolated from one another in a preferred embodiment, in order to avoid unwanted feedback. In one preferred embodiment, the interior of the in-ear assembly contains a baffle isolation structure that transverses the interior of the in-ear assembly, creating a physical isolation between the microphone and the playback module. In alternative embodiments, an acoustic isolation can be created without a physical barrier between the microphone and playback module. The isolation baffle achieves the goal of creating at least a 30 decibel noise isolation between the microphone and the playback module. Thus, the isolation of the microphone and playback module provides for reduction in noise interference and feedback noise between the microphone and playback module in a miniaturized apparatus such as the in-ear assembly, which has its exterior, or more specifically, the secondary chamber, exposed to the external environment's sound waves.

On the exterior of in-ear assembly, or the exterior of the primary chamber, is a stabilizing assembly or wingtip assembly, to ensure the in-ear assembly is securely placed on a user's ear, when in an operative position, and to provide the proper orientation(s) for the various structures, by way of example, the antihelix structure, to receive the input signals. The stabilizing assembly may comprise of a circular collar that is disposed about the exterior of the primary chamber, and a concha-shaped structure connected to the circular collar that is dimensioned and configured to be disposed on the external ear of a user when in an operative position, preferably within the concha. As such, the tragus and anti-helix structure can be oriented properly for generation of accurate HRTF signals, otherwise an improper orientation may generate misleading HRTF signals for the user.

In one embodiment, at least one in-ear assembly may form a system. In one embodiment of the system, the system may comprise a left ear-in assembly structured to pick up and filter sounds incoming from the left side of a user. The right in-ear assembly may be structured to pick up and filter sounds incoming from the right side of the user. A left preamplifier within the left in-ear assembly may be structured and configured to increase the gain of the filtered sound of the left in-ear assembly. A right preamplifier within the right in-ear assembly may be structured and configured to increase the gain of the filtered sound of the right in-ear assembly. The audio processor(s) located inside the left and right in-ear assemblies, or housed in a separate structure, may be configured to process and enhance the audio signal received from the left and right preamplifiers, and then transmit the respective processed signals to each of the left and right playback modules located in the left and right in-ear assemblies. The left and right playback modules or transducers are structured and configured to convert the electrical signals into sound waves perceptible by the user, such that the user can then perceive the filtered and enhanced sound form the user's environment, which includes the "directional" audio data that allows the user to localize the originating sound. The various structures, such as but not limited to the preamplifier(s), the audio processor(s), and the playback module(s) may be housed in the in-ear assembly(s) or in a separate interconnecting assembly attached to the in-ear assembly(s).

In at least one embodiment, the system of the present invention may comprise an in-ear assembly for each of a user's ear, as well as an interconnecting member which may further comprise the preamplifier(s), audio processor(s), playback module(s), as well as other appropriate circuitry and components. The interconnecting member may be worn around the neck, and connected to the in-ear assemblies, or in-ear bud assemblies, by wire connections, or may be wireless by use of Bluetooth or other suitable radio-frequency transmission technology. The interconnecting member may be formed from a flexible back section and stiff side sections. The interconnecting member may house a printed circuit board having various componentry, such as the audio processor. The interconnecting member can provide a user with volume control functions, providing a user a level of control with which to mix between environmental audio signals and voice communication signals. In one embodiment, the interconnecting member may have a listen mode and mute mode, providing a user with the ability to mute the microphone that receives environmental audio signals, allowing the user to receive and listen to phone calls, thereby providing a means of communication. The interconnecting member can also house a removable battery to charge the apparatus.

As can be seen, one particular use for the present invention lies in hearing protection systems for use in environments where situational awareness is critical. With suitable sound insulation and/or "anti-noise" signal generation capabilities, the system of the present invention provides a suitable noise-reduction assembly for the protection of the user's hearing against loud noises. Additionally, the microphone assembly allows external audio to be detected and delivered to at a safer level than would otherwise be perceived by the user. Finally, the tragus and anti-helix structure allow the "directional" information of ambient noises to be captured and faithfully recreated to the user by way of an HRTF signal. By way of example, the present invention may be useful in construction sites, where the need for hearing protection and situational awareness is a key component of on-site safety. By utilizing the present invention, user's need not sacrifice situational awareness for hearing protection.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE EMBODIMENT

As illustrated by the accompanying drawings, the present invention is directed to an apparatus, system, and method for generating a head related audio transfer function for a user. Specifically, some embodiments relate to capturing surrounding sound in the external environment in real time, filtering that sound through unique structures formed on the apparatus in order to generate audio positional data, and then processing that sound to enhance and relay the positional audio data to a user, such that the user can determine the origination of the sound in three dimensional space.

Figure 1:
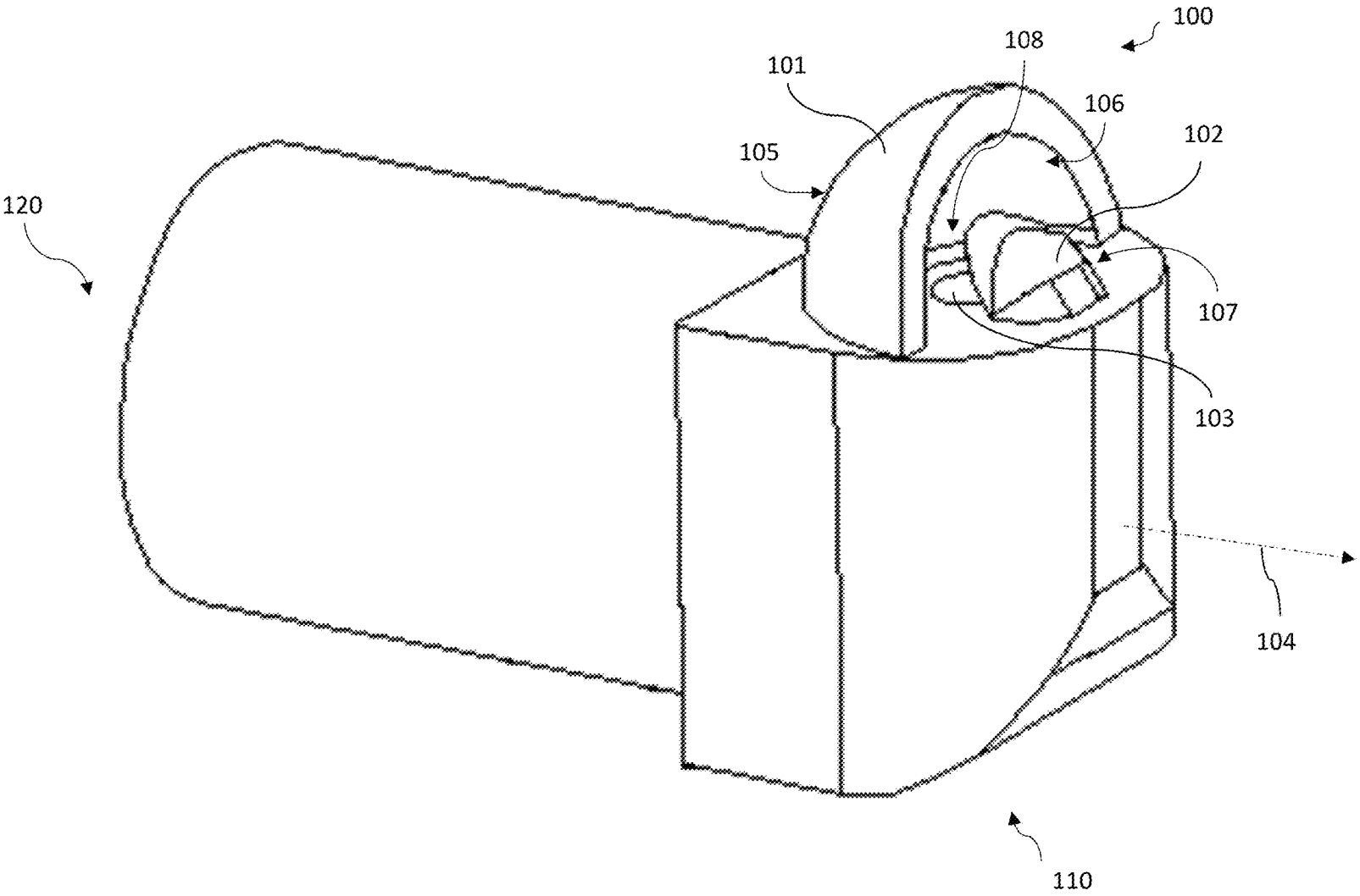
FIG. 1 is a perspective external view of an apparatus for generating a head related audio transfer function.
Figure 2:
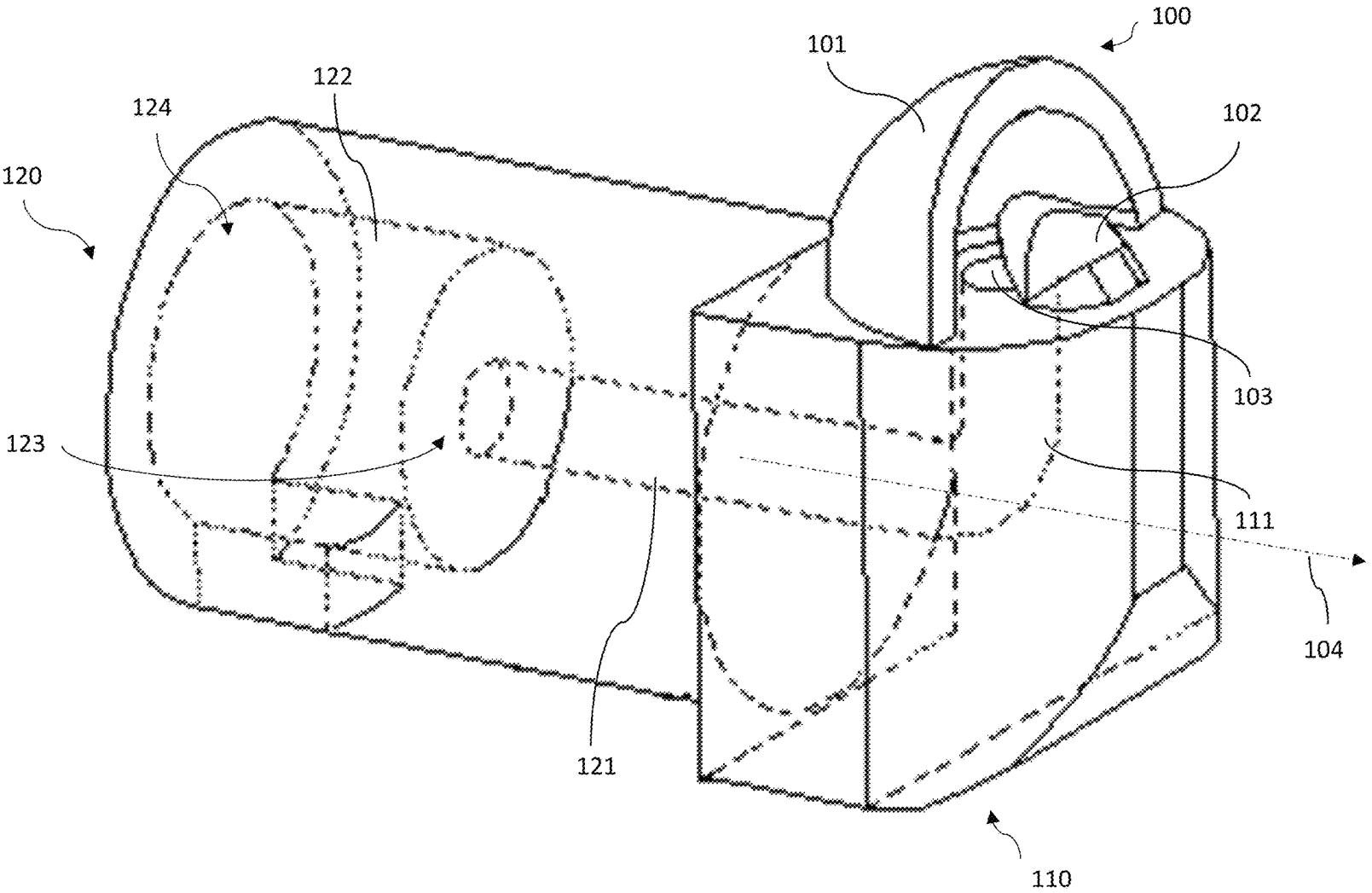
FIG. 2 is a perspective internal view of an apparatus for generating a head related audio transfer function.

As schematically represented, FIGS. 1 and 2 illustrate at least one preferred embodiment of an apparatus 100 for generating a head related audio transfer function for a user, or "HRTF generator". Accordingly, apparatus 100 comprises an external manifold 110 and an internal manifold 120. The external manifold 110 will be disposed at least partially on an exterior of the apparatus 100. The internal manifold 120, on the other hand, will be disposed along an interior of the apparatus 100. For further clarification, the exterior of the apparatus 100 comprises the external environment, such that the exterior is directly exposed to the air of the surrounding environment. The interior of the apparatus 100 comprises at least a partially sealed off environment that partially or fully obstructs the direct flow of acoustic waves.

The external manifold 110 may comprise a hexahedron shape having six faces. In at least one embodiment, the external manifold 110 is substantially cuboid. The external manifold 110 may comprise at least one surface that is concave or convex, such as an exterior surface exposed to the external environment. The internal manifold 120 may comprise a substantially cylindrical shape, which may be at least partially hollow. The external manifold 110 and internal manifold 120 may comprise sound dampening or sound proof materials, such as various foams, plastics, and glass known to those skilled in the art.

Drawing attention to FIG. 1, the external manifold 110 comprises an antihelix structure 101, a tragus structure 102, and an opening 103 that are externally visible. The opening 103 is in direct air flow communication with the surrounding environment, and as such will receive a flow of acoustic waves or vibrations in the air that passes through the opening 103. The tragus structure 102 is disposed to partially enclose the opening 103, and the antihelix structure 101 is disposed to partially enclose both the antihelix structure 102 and the opening 103.

In at least one embodiment, the antihelix structure 101 comprises a partial dome structure having a closed side 105 and an open side 106. In a preferred embodiment, the open side 106 faces the preferred listening direction 104, and the closed side 105 faces away from the preferred listening direction 104. The tragus structure 102 may also comprise a partial dome structure having a closed side 107 and an open side 108. In a preferred embodiment, the open side 108 faces away from the preferred listening direction 104, while the closed side 107 faces towards the preferred listening direction 104. In other embodiments, the open side 106 of the antihelix structure 101 may be in direct confronting relation to the open side 108 of the tragus structure 102, regardless of the preferred listening direction 104.

Partial dome as defined for the purposes of this document may comprise a half-dome structure or any combination of partial-dome structures. For instance, the anti-helix structure 101 of FIG. 1 comprises a half-dome, while the tragus structure 102 comprises a partial-dome wherein the base portion may be less than that of a half-dome, but the top portion may extend to or beyond the halfway point of a half-dome to provide increased coverage or enclosure of the opening 103 and other structures. Of course, in other variations, the top portion and bottom portion of the partial dome may vary in respective dimensions to form varying portions of a full dome structure, in order to create varying coverage of the opening 103. This allows the apparatus to produce different or enhanced acoustic input for calculating direction and distance of the source sound relative to the user.

In at least one embodiment, the antihelix structure 101 and tragus structure 102 may be modular, such that different sizes or shapes (variations of different partial domes or partial-domes) may be swapped out based on a user's preference for particular acoustic characteristics.

Drawing attention now to FIG. 2, the opening 103 is connected to, and in air flow communication with, an opening canal 111 inside the external manifold 110. In at least one embodiment, the opening canal 111 is disposed in a substantially perpendicular orientation relative to the desired listening direction 104 of the user. The opening canal 111 is further connected in air flow communication with an auditory canal 121. A portion of the auditory canal 121 may be formed in the external manifold 110. In various embodiments, the opening canal 111 and auditory canal 121 may be of a single piece construction. In other embodiments, a canal connector not shown may be used to connect the two segments. At least a portion of the auditory canal 121 may also be formed within the internal manifold 121.

As previously discussed, the internal manifold 120 is formed wholly or substantially within an interior of the apparatus, such that it is not exposed directly to the outside air and will not be substantially affected by the external environment. In at least one embodiment, the auditory canal 121 formed within at least a portion of the internal manifold 121, will be disposed in a substantially parallel orientation relative to desired listening direction 104 of the user. In a preferred embodiment, the auditory canal comprises a length that is greater than two times its diameter.

A microphone housing 122 is attached to an end of the auditory canal 121. Within the microphone housing 122, a microphone generally at 123, not shown, is mounted against the end of the auditory canal 121. In at least one embodiment, the microphone 123 is mounted flush against the auditory canal 121, such that the connection may be substantially air tight to avoid interference sounds. In a preferred embodiment, an air cavity generally at 124 is created behind the microphone and at the end of the internal manifold 120. This may be accomplished by inserting the microphone 123 into the microphone housing 122, and then sealing the end of the microphone housing, generally at 124, with a cap. The cap may be substantially air tight in at least one embodiment. Different gasses having different acoustic characteristics may be used within the air cavity.

Figure 3:
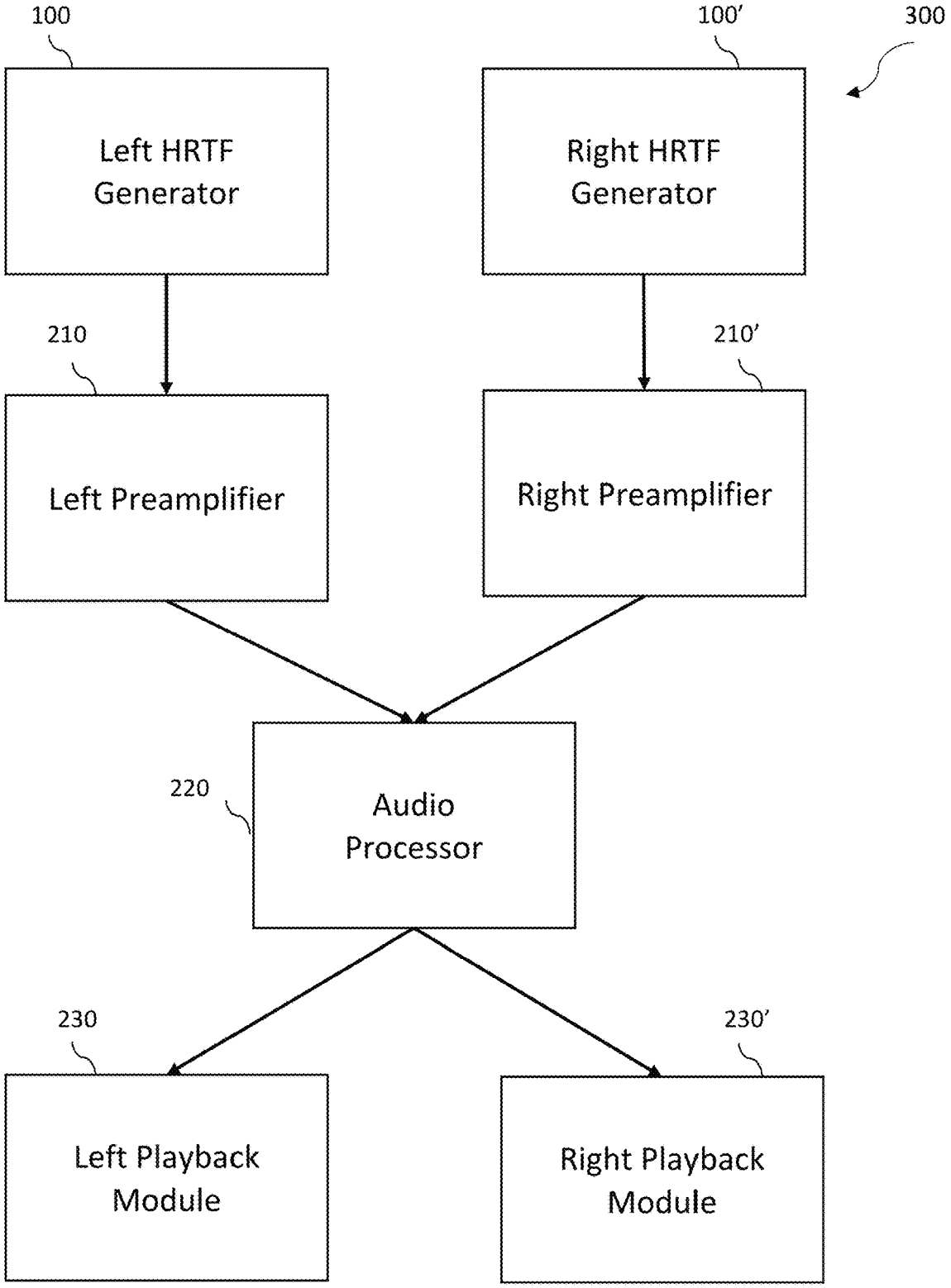
FIG. 3 is a block diagram directed to a system for generating a head related audio transfer function.

In at least one embodiment, apparatus 100 may form a part of a larger system 300 as illustrated in FIG. 3. Accordingly, a system 300 may comprise a left HRTF generator 100, a right HRTF generator 100', a left preamplifier 210, a right preamplifier 210', an audio processor 220, a left playback module 230, and a right playback module 230'.

The left and right HRTF generators 100 and 100' may comprise the apparatus 100 described above, each having unique structures such as the antihelix structure 101 and tragus structure 102. Accordingly, the HRTF generators 100/100' may be structured to generate a head related audio transfer function for a user, such that the sound received by the HRTF generators 100/100' may be relayed to the user to accurately communicate position data of the sound. In other words, the HRTF generators 100/100' may replicate and replace the function of the user's own left and right ears, where the HRTF generators would collect sound, and perform respective spectral transformations or a filtering process to the incoming sounds to enable the process of vertical localization to take place.

A left preamplifier 210 and right preamplifier 210' may then be used to enhance the filtered sound coming from the HRTF generators, in order to enhance certain acoustic characteristics to improve locational accuracy, or to filter out unwanted noise. The preamplifiers 210/210' may comprise an electronic amplifier, such as a voltage amplifier, current amplifier, transconductance amplifier, transresistance amplifier and/or any combination of circuits known to those skilled in the art for increasing or decreasing the gain of a sound or input signal. In at least one embodiment, the preamplifier comprises a microphone preamplifier configured to prepare a microphone signal to be processed by other processing modules. As it may be known in the art, microphone signals sometimes are too weak to be transmitted to other units, such as recording or playback devices with adequate quality. A microphone preamplifier thus increases a microphone signal to the line level by providing stable gain while preventing induced noise that might otherwise distort the signal.

Audio processor 230 may comprise a digital signal processor and amplifier, and may further comprise a volume control. Audio processor 230 may comprise a processor and combination of circuits structured to further enhance the audio quality of the signal coming from the microphone preamplifier, such as but not limited to shelf filters, equalizers, modulators. For example, in at least one embodiment the audio processor 230 may comprise a processor that performs the steps for processing a signal as taught by the present inventor's U.S. Pat. No. 8,160,274, the entire disclosure of which is incorporated herein by reference. Audio processor 230 may incorporate various acoustic profiles customized for a user and/or for an environment, such as those described in the present inventor's U.S. Pat. No. 8,565,449, the entire disclosure of which is incorporated herein by reference. Audio processor 230 may additionally incorporate processing suitable for high noise environments, such as those described in the present inventor's U.S. Pat. No. 8,462,963, the entire disclosure of which is incorporated herein by reference. Parameters of the audio processor 230 may be controlled and modified by a user via any means known to one skilled in the art, such as by a direct interface or a wireless communication interface.

The left playback module 230 and right playback module 230' may comprise headphones, earphones, speakers, or any other transducer known to one skilled in the art. The purpose of the left and right playback modules 230/230' is to convert the electrical audio signal from the audio processor 230 back into perceptible sound for the user. As such, a moving-coil transducer, electrostatic transducer, electret transducer, or other transducer technologies known to one skilled in the art may be utilized.

Figure 4A:
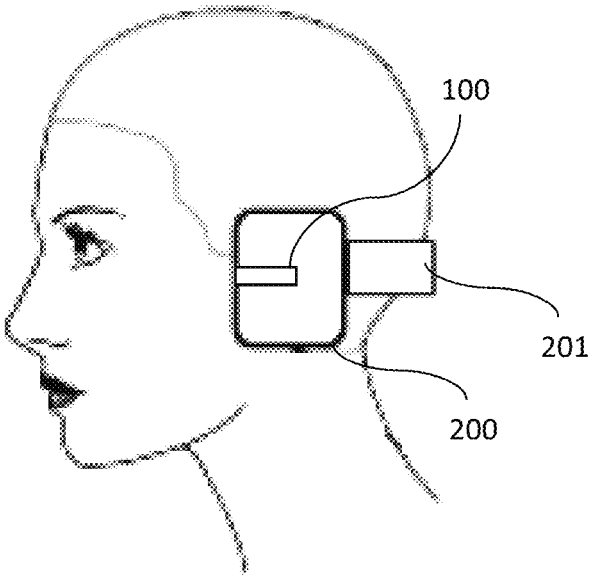
FIG. 4A illustrates a side profile view of a wearable device comprising an apparatus for generating a head related audio transfer function.
Figure 4B:
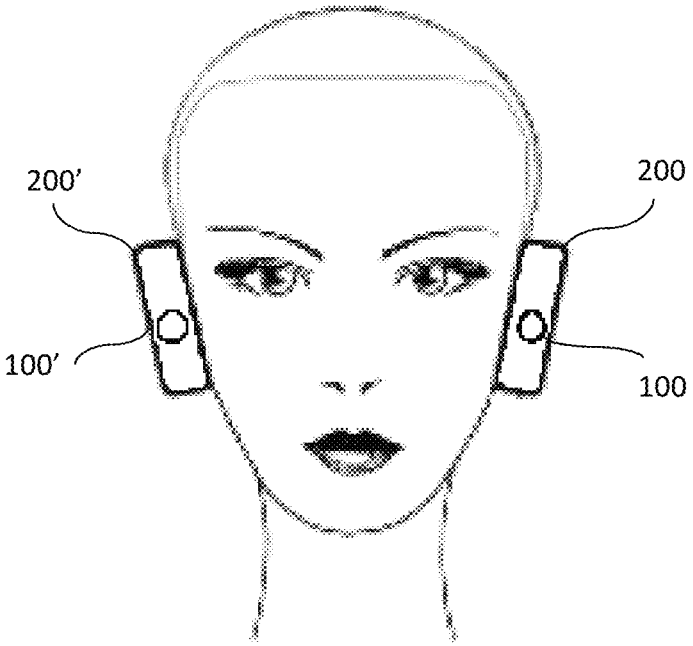
FIG. 4B illustrates a front profile view of a wearable device comprising an apparatus for generating a head related audio transfer function.

In at least one embodiment, the present system 200 comprises a device 200 as generally illustrated at FIGS. 4A and 4B, which may be a wearable headset 200 having the apparatus 100 embedded therein, as well as various amplifiers including but not limited to 210/210', processors such as 220, playback modules such as 230/230', and other appropriate circuits or combinations thereof for receiving, transmitting, enhancing, and reproducing sound.

Figure 5:
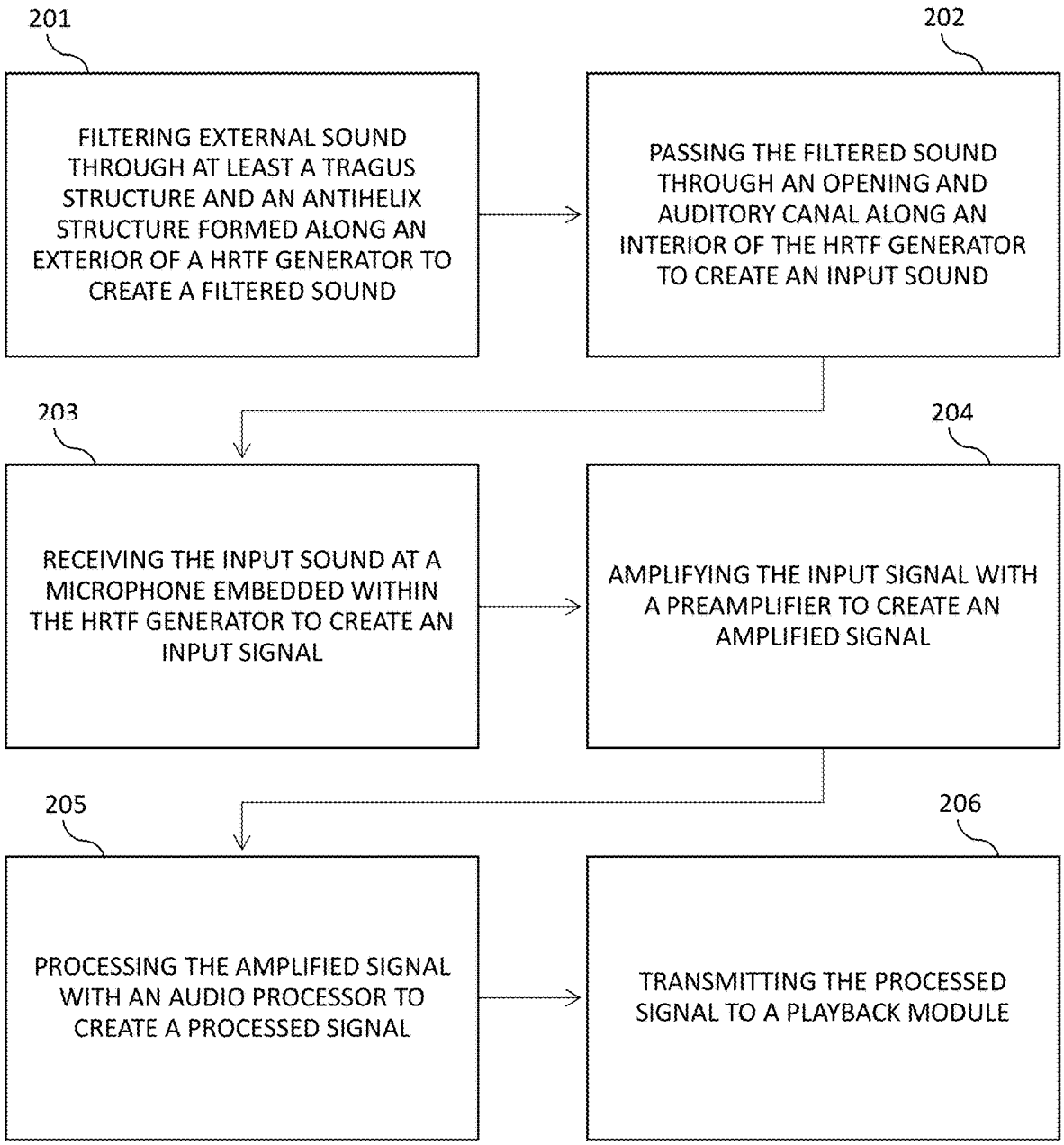
FIG. 5 illustrates a flowchart directed to a method for generating a head related audio transfer function.

In a further embodiment as illustrated in FIG. 5, a method for generating a head related audio transfer function is shown. Accordingly, external sound is first filtered through at least a tragus structure and an antihelix structure formed along an exterior of an HRTF generator, as in 201, in order to create a filtered sound. Next, the filtered sound is passed through an opening and auditory canal along an interior of the HRTF generator, as in 202, in order to create an input sound. The input sound is received at a microphone embedded within the HRTF generator, as in 203, in order to create an input signal. The input signal is then amplified with a preamplifier, as in 204, in order to create an amplified signal. The amplified signal is processed with an audio processor, as in 205, in order to create a processed signal. Finally, the processed signal is transmitted to a playback module, as in 206, in order to relay the audio and/or locational audio data to the user.

In a preferred embodiment of the present invention, the method of FIG. 5 may perform the locational audio capture and transmission to a user in real time. This facilitates usage in a hearing assistance situation, such as a hearing aid for a user with impaired hearing. This also facilitates usage in a high noise environment, such as to filter out noises and/or enhancing human speech.

In at least one embodiment, the method of FIG. 5 may further comprise a calibration process, such that each user can replicate his or her unique HRTF in order to provide for accurate localization of a sound in three dimensional space. The calibration may comprise adjusting the antihelix and tragus structures as described above, which may be formed of modular and/or moveable components. Thus, the antihelix and/or tragus structure may be repositioned, and/or differently shaped and/or sized structures may be used. In further embodiments, the audio processor 230 described above may be further calibrated to adjust the acoustic enhancement of certain sound waves relative to other sound waves and/or signals.

Figure 6:
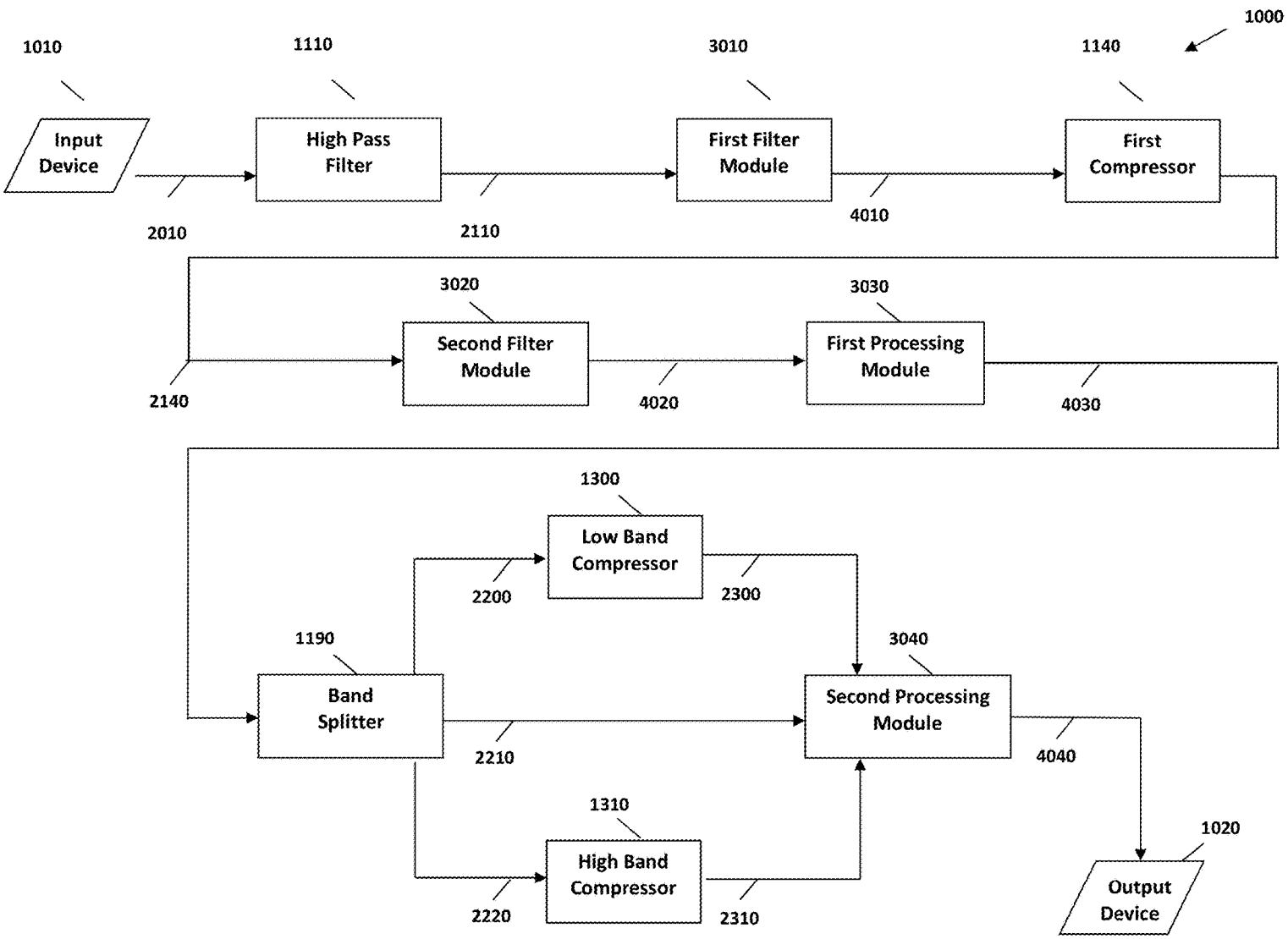
FIG. 6 illustrates a schematic of one embodiment of an audio processor according to one embodiment of the present invention.
Figure 7:
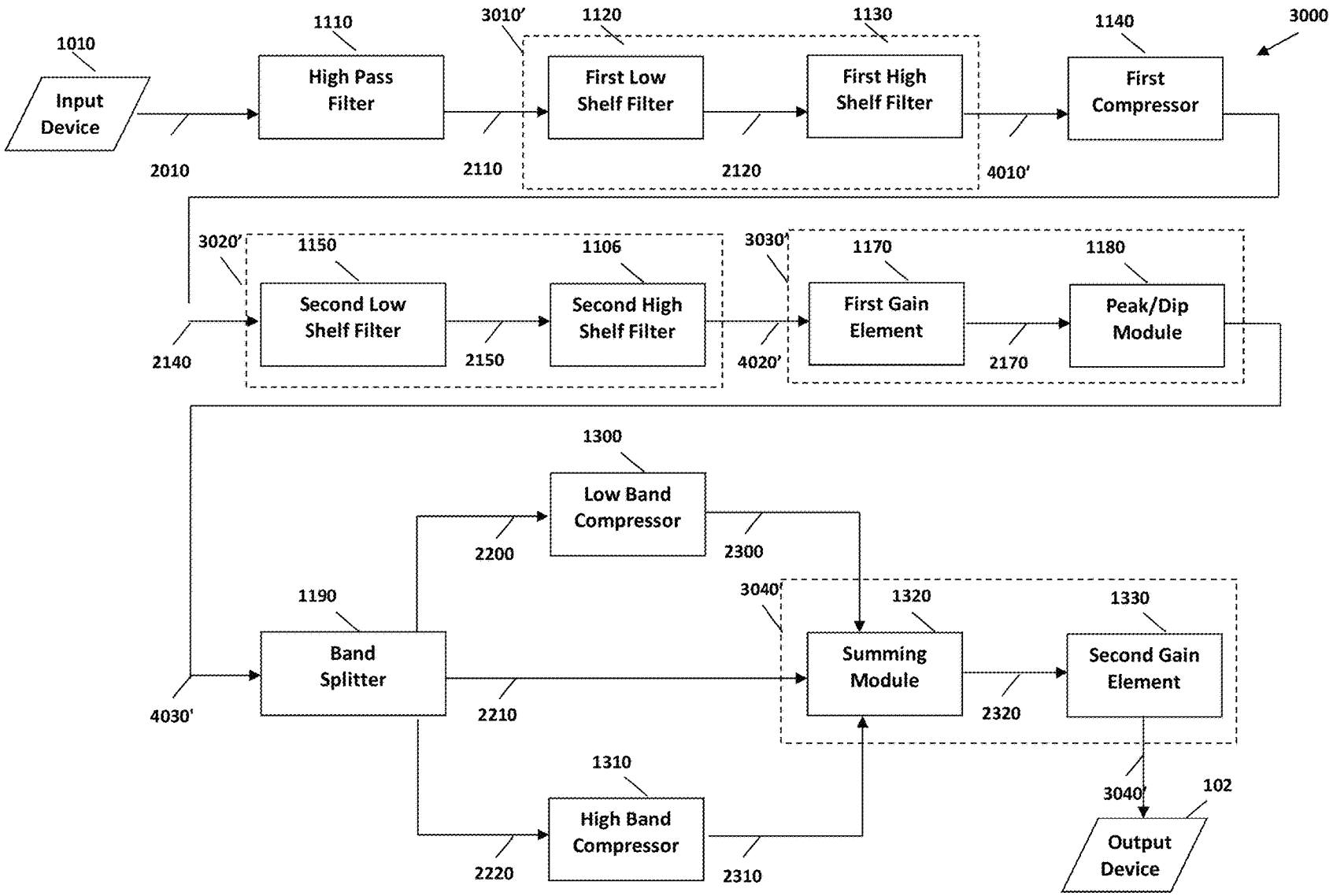
FIG. 7 illustrates a schematic of another embodiment of an audio processor according to one embodiment of the present invention.

With regard to FIG. 6, one embodiment of an audio processor 230 is represented schematically as a system 1000. As schematically represented, FIG. 6 illustrates at least one preferred embodiment of a system 1000, and FIG. 7 provides examples of several subcomponents and combinations of subcomponents of the modules of FIG. 6. Accordingly, and in these embodiments, the systems 1000 and 3000 generally comprise an input device 1010 (such as the left preamplifier 210 and/or right preamplifier 210'), a high pass filter 1110, a first filter module 3010, a first compressor 1140, a second filter module 3020, a first processing module 3030, a band splitter 1190, a low band compressor 1300, a high band compressor 1310, a second processing module 3040, and an output device 1020.

The input device 1010 is at least partially structured or configured to transmit an input audio signal 2010, such as an amplified signal from a left or right preamplifier 210, 210', into the system 1000 of the present invention, and in at least one embodiment into the high pass filter 1110.

The high pass filter 1110 is configured to pass through high frequencies of an audio signal, such as the input signal 2010, while attenuating lower frequencies, based on a predetermined frequency. In other words, the frequencies above the predetermined frequency may be transmitted to the first filter module 3010 in accordance with the present invention. In at least one embodiment, ultra-low frequency content is removed from the input audio signal, where the predetermined frequency may be selected from a range between 300 Hz and 3 kHz. The predetermined frequency however, may vary depending on the source signal, and vary in other embodiments to comprise any frequency selected from the full audible range of frequencies between 20 Hz to 20 kHz. The predetermined frequency may be tunable by a user, or alternatively be statically set. The high pass filter 1110 may further comprise any circuits or combinations thereof structured to pass through high frequencies above a predetermined frequency, and attenuate or filter out the lower frequencies.

The first filter module 3010 is configured to selectively boost or attenuate the gain of select frequency ranges within an audio signal, such as the high pass signal 2110. For example, and in at least one embodiment, frequencies below a first frequency may be adjusted by ±X dB, while frequencies above a first frequency may be adjusted by ±Y dB. In other embodiments, a plurality of frequencies may be used to selectively adjust the gain of various frequency ranges within an audio signal. In at least one embodiment, the first filter module 3010 may be implemented with a first low shelf filter 1120 and a first high shelf filter 1130, as illustrated in FIG. 6. The first low shelf filter 1120 and first high shelf filter 1130 may both be second-order filters. In at least one embodiment, the first low shelf filter 1120 attenuates content below a first frequency, and the first high shelf filter 1120 boosts content above a first frequency. In other embodiments, the frequency used for the first low shelf filter 1120 and first high shelf filter 1130 may comprise two different frequencies. The frequencies may be static or adjustable. Similarly, the gain adjustment (boost or attenuation) may be static or adjustable.

The first compressor 1140 is configured to modulate a signal, such as the first filtered signal 4010. The first compressor 1120 may comprise an automatic gain controller. The first compressor 1120 may comprise standard dynamic range compression controls such as threshold, ratio, attack and release. Threshold allows the first compressor 1120 to reduce the level of the filtered signal 2110 if its amplitude exceeds a certain threshold. Ratio allows the first compressor 1120 to reduce the gain as determined by a ratio. Attack and release determines how quickly the first compressor 1120 acts. The attack phase is the period when the first compressor 1120 is decreasing gain to reach the level that is determined by the threshold. The release phase is the period that the first compressor 1120 is increasing gain to the level determined by the ratio. The first compressor 1120 may also feature soft and hard knees to control the bend in the response curve of the output or modulated signal 2120, and other dynamic range compression controls appropriate for the dynamic compression of an audio signal. The first compressor 1120 may further comprise any device or combination of circuits that is structured and configured for dynamic range compression.

The second filter module 3020 is configured to selectively boost or attenuate the gain of select frequency ranges within an audio signal, such as the modulated signal 2140. In at least one embodiment, the second filter module 3020 is of the same configuration as the first filter module 3010. Specifically, the second filter module 3020 may comprise a second low shelf filter 1150 and a second high shelf filter 1160. In certain embodiments, the second low shelf filter 1150 may be configured to filter signals between 100 Hz and 3000 Hz, with an attenuation of between −5 dB to −20 dB. In certain embodiments the second high shelf filter 1160 may be configured to filter signals between 100 Hz and 3000 Hz, with a boost of between +5 dB to +20 dB.

The second filter module 3020 may be configured in at least a partially inverse configuration to the first filter module 3010. For instance, the second filter module may use the same frequency, for instance the first frequency, as the first filter module. Further, the second filter module may adjust the gain inversely to the gain or attenuation of the first filter module, of content above the first frequency. Similarly second filter module may also adjust the gain inversely to the gain or attenuation of the of the first filter module, of content below the first frequency. In other words, the purpose of the second filter module in one embodiment may be to "undo" the gain adjustment that was applied by the first filter module.

The first processing module 3030 is configured to process a signal, such as the second filtered signal 4020. In at least one embodiment, the first processing module 3030 may comprise a peak/dip module, such as 1180 represented in FIG. 7. In other embodiments, the first processing module 3030 may comprise a first gain element 1170. In various embodiments, the processing module 3030 may comprise both a first gain element 1170 and a peak/dip module 1180 for the processing of a signal. The first gain element 1170, in at least one embodiment, may be configured to adjust the level of a signal by a static amount. The first gain element 1170 may comprise an amplifier or a multiplier circuit. In other embodiments, dynamic gain elements may be used. The peak/dip module 1180 is configured to shape the desired output spectrum, such as to increase or decrease overshoots or undershoots in the signal. In some embodiments, the peak/dip module may further be configured to adjust the slope of a signal, for instance for a gradual scope that gives a smoother response, or alternatively provide for a steeper slope for more sudden sounds. In at least one embodiment, the peak/dip module 1180 comprises a bank of ten cascaded peak/dipping filters. The bank of ten cascaded peaking/dipping filters may further be second-order filters. In at least one embodiment, the peak/dip module 1180 may comprise an equalizer, such as parametric or graphic equalizers.

The band splitter 1190 is configured to split a signal, such as the processed signal 4030. In at least one embodiment, the signal is split into a low band signal 2200, a mid band signal 2210, and a high band signal 2220. Each band may be the output of a fourth order section, which may be further realized as the cascade of second order biquad filters. In other embodiments, the band splitter may comprise any combination of circuits appropriate for splitting a signal into three frequency bands. The low, mid, and high bands may be predetermined ranges, or may be dynamically determined based on the frequency itself, i.e. a signal may be split into three even frequency bands, or by percentage. The different bands may further be defined or configured by a user and/or control mechanism.

A low band compressor 1300 is configured to modulate the low band signal 2200, and a high band compressor 1310 is configured to modulate the high band signal 2220. In at least one embodiment, each of the low band compressor 1300 and high band compressor 1310 may be the same as the first compressor 1140. Accordingly, each of the low band compressor 1300 and high band compressor 1310 may each be configured to modulate a signal. Each of the compressors 1300, 1310 may comprise an automatic gain controller, or any combination of circuits appropriate for the dynamic range compression of an audio signal.

A second processing module 3040 is configured to process at least one signal, such as the modulated low band signal 2300, the mid band signal 2210, and the modulated high band signal 2310. Accordingly, the second processing module 3040 may comprise a summing module 1320 configured to combine a plurality of signals. The summing module 1320 may comprise a mixer structured to combine two or more signals into a composite signal. The summing module 1320 may comprise any circuits or combination thereof structured or configured to combine two or more signals. In at least one embodiment, the summing module 1320 comprises individual gain controls for each of the incoming signals, such as the modulated low band signal 2300, the mid band signal 2210, and the modulated high band signal 2310. In at least one embodiment, the second processing module 3040 may further comprise a second gain element 1330. The second gain element 1330, in at least one embodiment, may be the same as the first gain element 1170. The second gain element 1330 may thus comprise an amplifier or multiplier circuit to adjust the signal, such as the combined signal, by a predetermined amount.

The output device 1020 may comprise the left playback module 230 and/or right playback module 230'.

Figure 8:
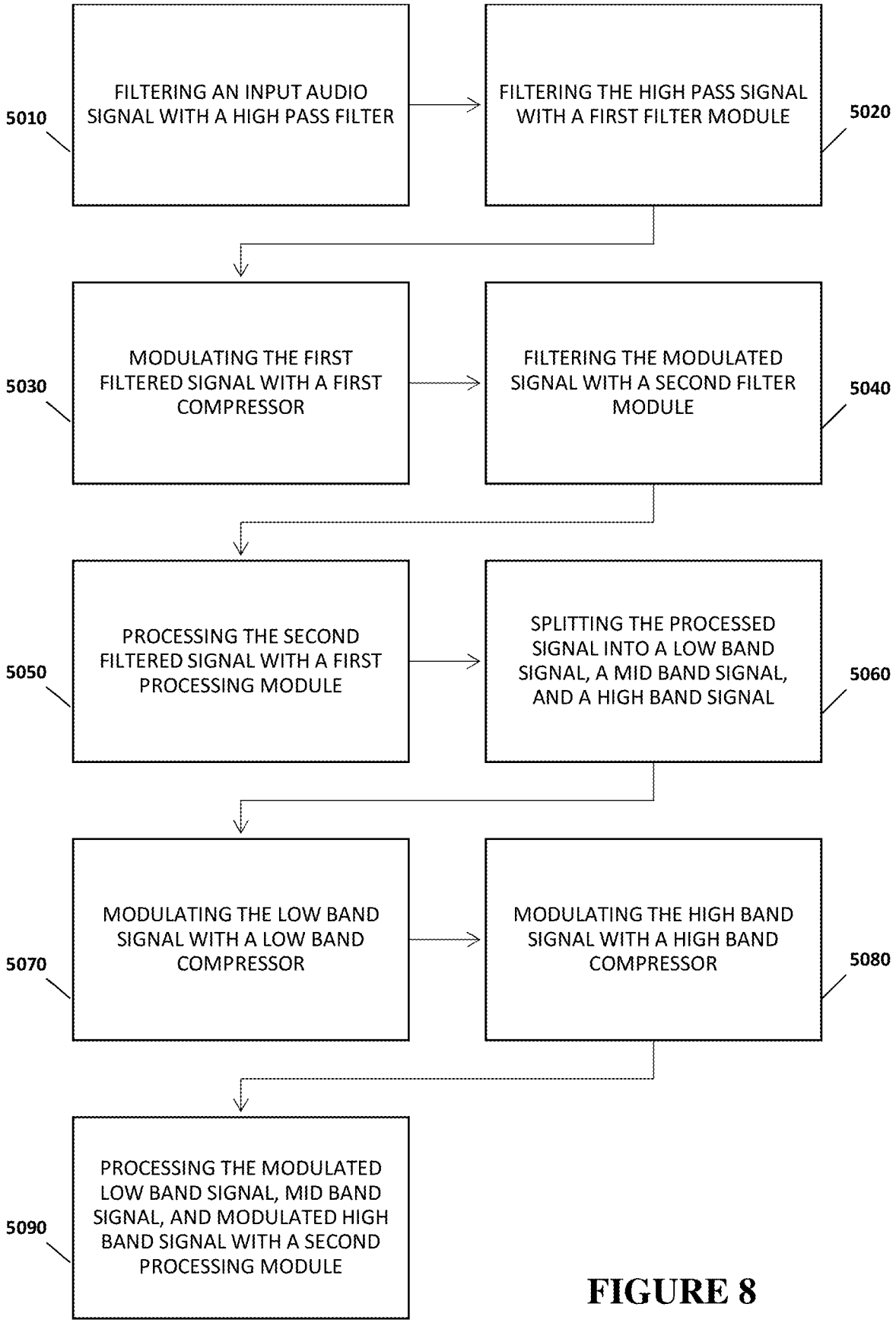
FIG. 8 illustrates a block diagram of one method for processing an audio signal with an audio processor according to one embodiment of the present invention.

As diagrammatically represented, FIG. 8 illustrates a block diagram of one method for processing an audio signal with an audio processor 220, which may in at least one embodiment incorporate the components or combinations thereof from the systems 1000 and/or 3000 referenced above. Each step of the method in FIG. 8 as detailed below may also be in the form of a code segment stored on a non-transitory computer readable medium for execution by the audio processor 220.

Accordingly, an input audio signal, such as the amplified signal, is first filtered, as in 5010, with a high pass filter to create a high pass signal. The high pass filter is configured to pass through high frequencies of a signal, such as the input signal, while attenuating lower frequencies. In at least one embodiment, ultra-low frequency content is removed by the high-pass filter. In at least one embodiment, the high pass filter may comprise a fourth-order filter realized as the cascade of two second-order biquad sections. The reason for using a fourth order filter broken into two second order sections is that it allows the filter to retain numerical precision in the presence of finite word length effects, which can happen in both fixed and floating point implementations. An example implementation of such an embodiment may assume a form similar to the following:

Two memory locations are allocated, designated as d(k−1) and d(k−2), with each holding a quantity known as a state variable. For each input sample x(k), a quantity d(k) is calculated using the coefficients a1 and a2:

$$d(k)=x(k)-a1*d(k-1)-a2*d(k-2)$$

The output y(k) is then computed, based on coefficients b0, b1, and b2, according to:

$$y(k)=b0*d(k)+b1*d(k-1)+b2*d(k-2)$$

The above computation comprising five multiplies and four adds is appropriate for a single channel of second-order biquad section. Accordingly, because the fourth-order high pass filter is realized as a cascade of two second-order biquad sections, a single channel of fourth order input high pass filter would require ten multiples, four memory locations, and eight adds.

The high pass signal from the high pass filter is then filtered, as in 5020, with a first filter module to create a first filtered signal. The first filter module is configured to selectively boost or attenuate the gain of select frequency ranges within an audio signal, such as the high pass signal. Accordingly, the first filter module may comprise a second order low shelf filter and a second order high shelf filter in at least one embodiment. In at least one embodiment, the first filter module boosts the content above a first frequency by a certain amount, and attenuates the content below a first frequency by a certain amount, before presenting the signal to a compressor or dynamic range controller. This allows the dynamic range controller to trigger and adjust higher frequency material, whereas it is relatively insensitive to lower frequency material.

The first filtered signal from the first filter module is then modulated, as in 5030, with a first compressor. The first compressor may comprise an automatic or dynamic gain controller, or any circuits appropriate for the dynamic compression of an audio signal. Accordingly, the compressor may comprise standard dynamic range compression controls such as threshold, ratio, attack and release. An example implementation of the first compressor may assume a form similar to the following:

The compressor first computes an approximation of the signal level, where att represents attack time; rel represents release time; and invThr represents a precomputed threshold:

```
temp = abs(x(k))
if temp > level (k-1)
  level(k) = att * (level(k-1) − temp) + temp
else
  level = rel * (level(k-1) − temp) + temp
```

This level computation is done for each input sample. The ratio of the signal's level to invThr then determines the next step. If the ratio is less than one, the signal is passed through unaltered. If the ratio exceeds one, a table in the memory may provide a constant that's a function of both invThr and level:

```
if (level * thr < 1)
  output(k) = x(k)
else
  index = floor(level * invThr)
if (index > 99)
  index = 99
gainReduction = table[index]
output(k) = gainReduction * x(k)
```

The modulated signal from the first compressor is then filtered, as in 5040, with a second filter module to create a second filtered signal. The second filter module is configured to selectively boost or attenuate the gain of select frequency ranges within an audio signal, such as the modulated signal. Accordingly, the second filter module may comprise a second order low shelf filter and a second order high shelf filter in at least one embodiment. In at least one embodiment, the second filter module boosts the content above a second frequency by a certain amount, and attenuates the content below a second frequency by a certain amount. In at least one embodiment, the second filter module adjusts the content below the first specified frequency by a fixed amount, inverse to the amount that was removed by the first filter module. By way of example, if the first filter module boosted content above a first frequency by +X dB and attenuated content below a first frequency by −Y dB, the second filter module may then attenuate the content above the first frequency by −X dB, and boost the content below the first frequency by +Y dB. In other words, the purpose of the second filter module in one embodiment may be to "undo" the filtering that was applied by the first filter module.

The second filtered signal from the second filter module is then processed, as in 5050, with a first processing module to create a processed signal. The processing module may comprise a gain element configured to adjust the level of the signal. This adjustment, for instance, may be necessary because the peak-to-average ratio was modified by the first compressor. The processing module may comprise a peak/dip module. The peak/dip module may comprise ten cascaded second-order filters in at least one embodiment. The peak/dip module may be used to shape the desired output spectrum of the signal. In at least one embodiment, the first processing module comprises only the peak/dip module. In other embodiments, the first processing module comprises a gain element followed by a peak/dip module.

The processed signal from the first processing module is then split, as in 5060, with a band splitter into a low band signal, a mid band signal, and a high band signal. The band splitter may comprise any circuit or combination of circuits appropriate for splitting a signal into a plurality of signals of different frequency ranges. In at least one embodiment, the band splitter comprises a fourth-order band-splitting bank. In this embodiment, each of the low band, mid band, and high band are yielded as the output of a fourth-order section, realized as the cascade of second-order biquad filters.

The low band signal is modulated, as in 5070, with a low band compressor to create a modulated low band signal. The low band compressor may be configured and/or computationally identical to the first compressor in at least one embodiment. The high band signal is modulated, as in 5080, with a high band compressor to create a modulated high band signal. The high band compressor may be configured and/or computationally identical to the first compressor in at least one embodiment.

The modulated low band signal, mid band signal, and modulated high band signal are then processed, as in 5090, with a second processing module. The second processing module comprises at least a summing module. The summing module is configured to combine a plurality of signals into one composite signal. In at least one embodiment, the summing module may further comprise individual gain controls for each of the incoming signals, such as the modulated low band signal, the mid band signal, and the modulated high band signal. By way of example, an output of the summing module may be calculated by:

$$out=w0*low+w1*mid+w2*high$$

The coefficients w0, w1, and w2 represent different gain adjustments. The second processing module may further comprise a second gain element. The second gain element may be the same as the first gain element in at least one embodiment. The second gain element may provide a final gain adjustment. Finally, the second processed signal is transmitted as the output signal.

Figure 9:
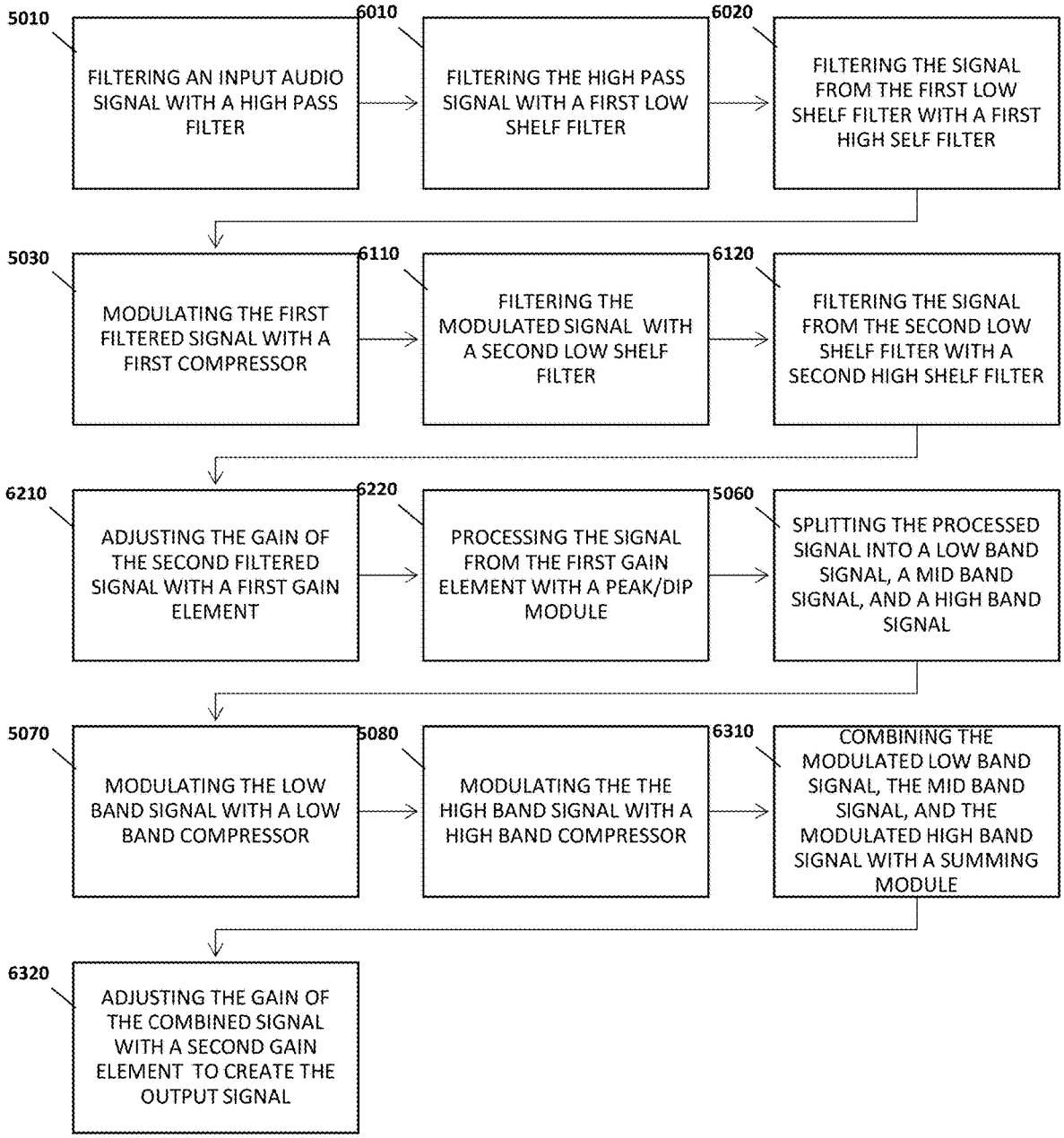
FIG. 9 illustrates a block diagram of another method for processing an audio signal with an audio processor according to another embodiment of the present invention.

As diagrammatically represented, FIG. 9 illustrates a block diagram of one method for processing an audio signal with an audio processor 220, which may in at least one embodiment incorporate the components or combinations thereof from the systems 1000 and/or 3000 referenced above. Because the individual components of FIG. 9 have been discussed in detail above, they will not be discussed here. Further, each step of the method in FIG. 9 as detailed below may also be in the form of a code segment directed to at least one embodiment of the present invention, which is stored on a non-transitory computer readable medium, for execution by the audio processor 220 of the present invention.

Accordingly, an input audio signal is first filtered, as in 5010, with a high pass filter. The high pass signal from the high pass filter is then filtered, as in 6010, with a first low shelf filter. The signal from the first low shelf filter is then filtered with a first high shelf filter, as in 6020. The first filtered signal from the first low shelf filter is then modulated with a first compressor, as in 5030. The modulated signal from the first compressor is filtered with a second low shelf filter as in 6110. The signal from the low shelf filter is then filtered with a second high shelf filter, as in 6120. The second filtered signal from the second low shelf filter is then gain-adjusted with a first gain element, as in 6210. The signal from the first gain element is further processed with a peak/dip module, as in 6220. The processed signal from the peak/dip module is then split into a low band signal, a mid band signal, and a high band signal, as in 5060. The low band signal is modulated with a low band compressor, as in 5070. The high band signal is modulated with a high band compressor, as in 5080. The modulated low band signal, mid band signal, and modulated high band signal are then combined with a summing module, as in 6310. The combined signal is then gain adjusted with a second gain element in order to create the output signal, as in 6320.

It should be understood that the above steps may be conducted exclusively or nonexclusively and in any order. Further, the physical devices recited in the methods may comprise any apparatus and/or systems described within this document or known to those skilled in the art.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Figure 10:
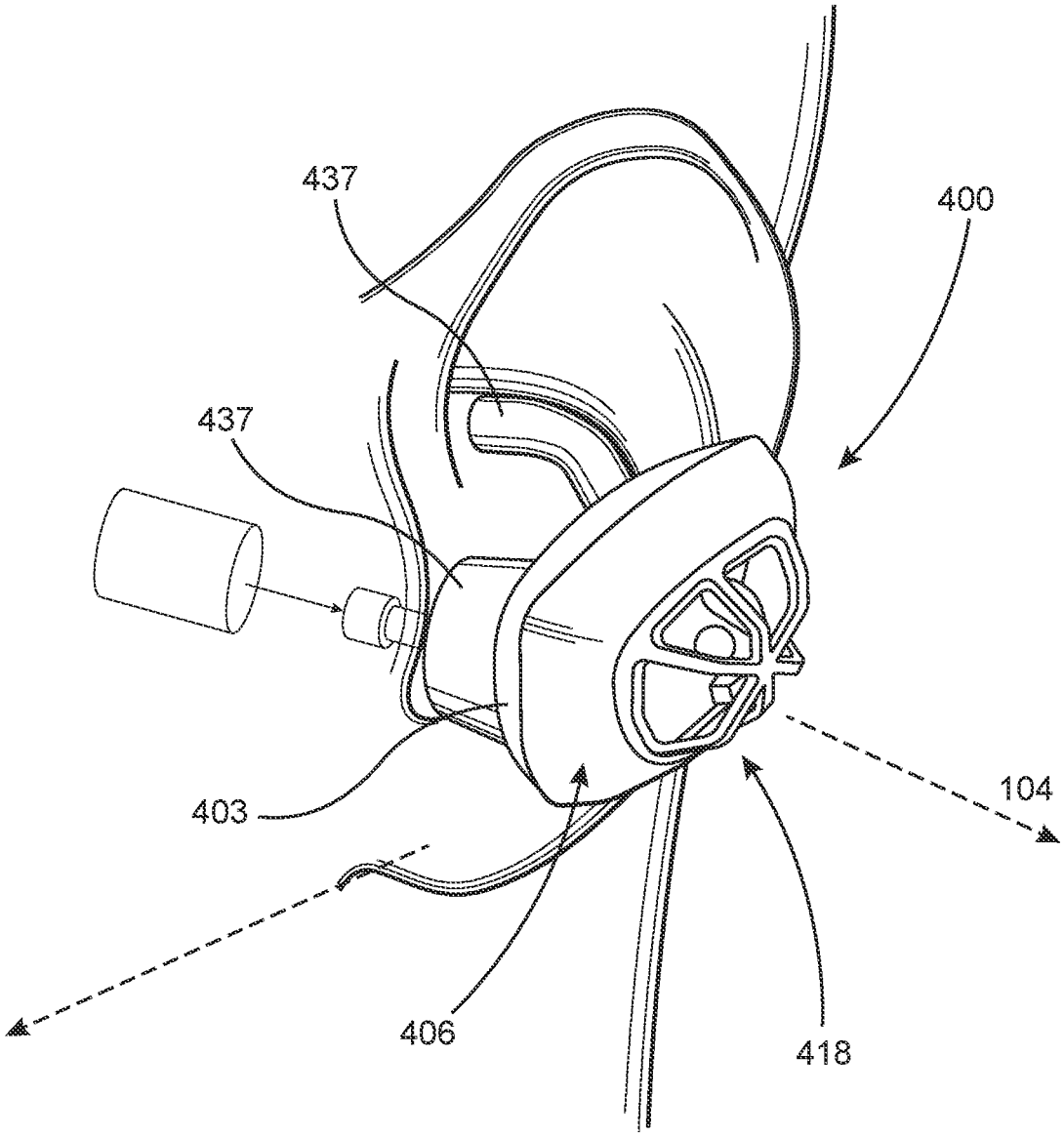
FIG. 10 illustrates an external view of a wearable in-ear assembly for hearing enhancement and protection capable of generating a head related audio transfer function for a user.

In one preferred embodiment, FIG. 10 illustrates a wearable apparatus for hearing enhancement and protection, capable of generating a head related audio transfer function (HRTF) for a user, comprising at least one in-ear assembly 400. As illustrated in FIG. 10, the in-ear assembly 400 is structured to be disposed inside and/or partially outside of at least one of a user's ears, when in an operative position, or when operatively positioned. One purpose of the in-ear assembly 400 is to capture sound from a user's external environment in real time, filter the sound through the unique structures formed on and in the in-ear assembly 400 in order to generate audio positional or directional data, process the sound to enhance the quality of the audio positional data, enhance and amplify the sound by means of various preamplifiers, and relay the audio positional data to a user by means of a playback module, speaker, or a variety of other transducers, allowing the user to effectively determine the origination of the sound in three dimensional space.

The in-ear assembly 400 comprises at least one chamber, shell, or chassis, which houses the various structures on the interior of the in-ear assembly 400, and provides exterior surfaces to house the structures that mimic the functions of a human ear for generating a head related audio transfer function ("HRTF"). Drawing attention to the embodiment in FIGS. 10 and 11, the in-ear assembly 400 comprises at least a primary chamber 403 and a secondary chamber 406. As illustrated in FIG. 10, the primary chamber 403 is situated proximally to a user's ear and the secondary chamber 406 is located distally to a user's ear when the in-ear assembly 400 is worn by a user.

Figure 11:
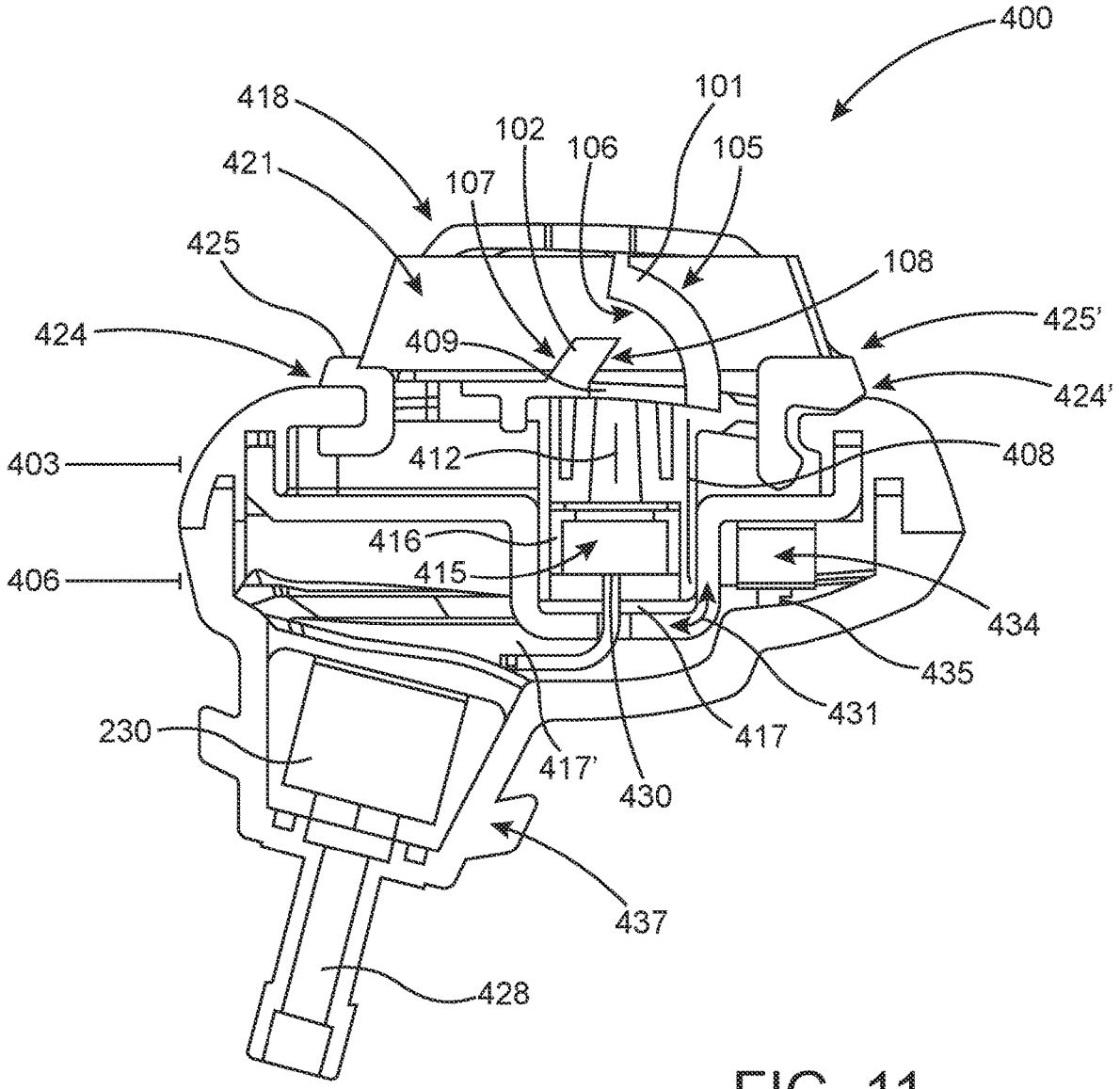
FIG. 11 is an interior sectional view of the embodiment of FIG. 10.

As illustrated in FIG. 11, the exterior, or outside surface, of the secondary chamber 406 of the in-ear assembly 400 will be at least partially open or exposed to the external environment, providing a means for the in-ear assembly 400 to receive sound, captured by a microphone 415. The interior of the in-ear assembly 400 comprises at least a partially sealed off environment that partially or fully obstructs the direct flow of acoustic waves, ensuring that noise interference from the external environment will not impede the quality of the audio input received by the microphone 415. Generally, the microphone 415 will relay the audio input sound to a playback module 230, which will transmit the audio output sound to a user by means of an auditory channel 428 connected to a user's ear(s) in an operative position. The secondary chamber 406 and the primary chamber 403 may comprise sound dampening or sound proof materials such as, but not limited to, various foams, plastics, and glass. The primary chamber and the secondary chamber 406 can be made out of a hard, strong plastic or a plurality of other materials.

Figure 12:
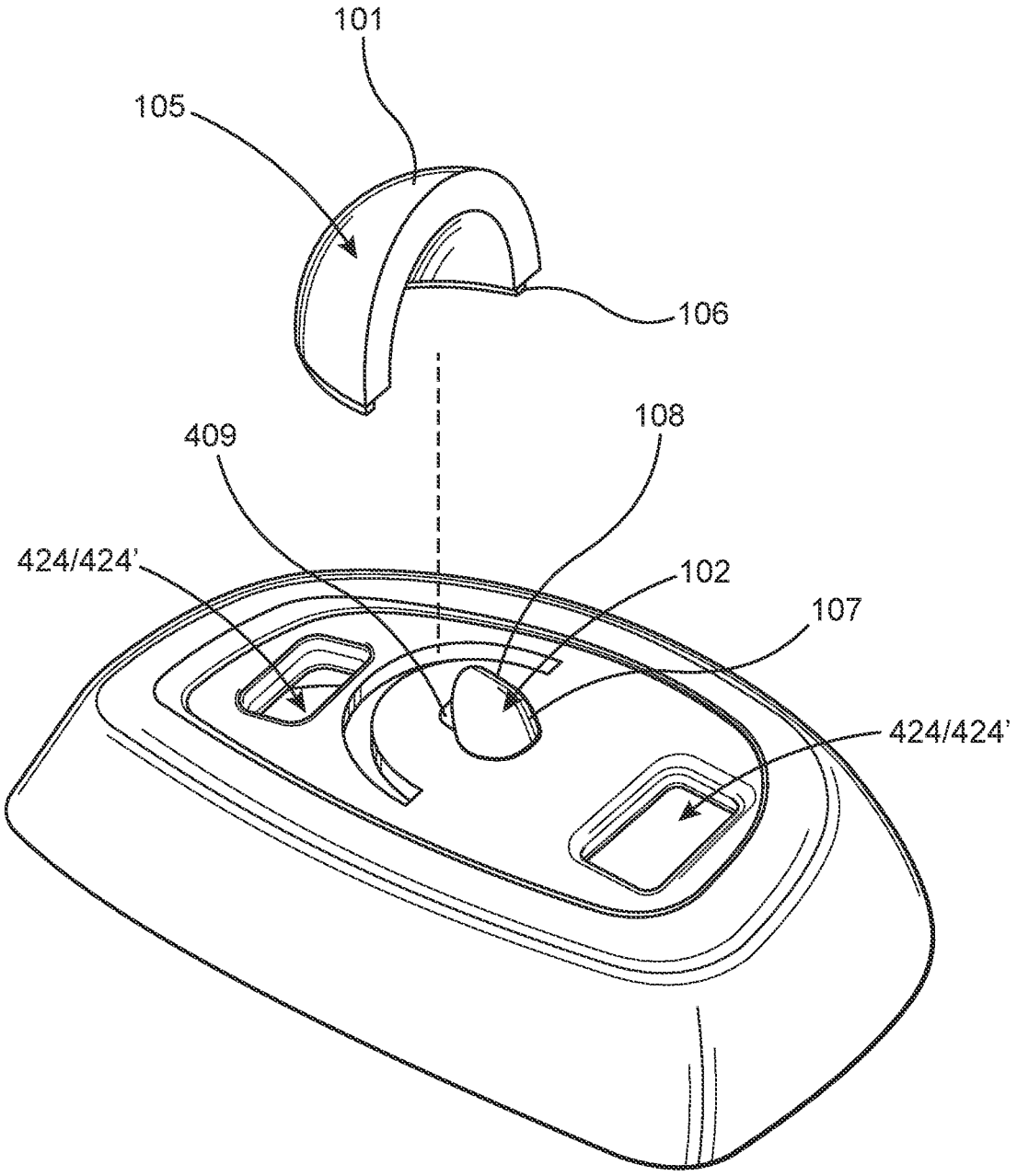
FIG. 12 illustrates a top perspective view in partially exploded form of a portion of the embodiment of FIGS. 10 and 11.

Drawing attention to FIGS. 11 and 12, the exterior surface of the secondary chamber 406 comprises at least an antihelix structure 101, a tragus structure 102, and a microphone aperture 409. The microphone aperture 409 is in direct air flow communication with the surrounding environment, and as such will receive a flow of acoustic sound waves or vibrations in the air that are filtered and passed through the antihelix structure 101 and the tragus structure 102. The antihelix structure 101 and the tragus structure 102 mimic the function of the external part of the human ear, the pinna, which assist and act as a funnel in directing and filtering the sound or audio input into the microphone aperture 409, through the microphone channel 412, and received into the microphone 415. As noted previously, in one embodiment, the in-ear assembly 400 may also include a preamplifier 210, as schematically illustrated in FIG. 3, to amplify the filtered audio input signal, as well as an audio processor 220, also illustrated in FIG. 3, to process the amplified signal, and create a processed signal to be received by the playback module 230', which will communicate the audio and/or locational audio data to the user.

As illustrated in FIGS. 11 and 12, the tragus structure 102 is disposed to partially enclose the microphone aperture 409, and the antihelix structure 101 is disposed to partially enclose both the tragus structure 102 and the microphone aperture 406. The antihelix structure 101 comprises a partial dome structure having a close side 105 and an open side 106. The tragus structure 102 may also comprise an at least partial dome structure having a closed side 107 and an open side 108. In a preferred embodiment, the open side 106 of the antihelix structure 101 may be in direct confronting relation to the open side 108 of the tragus structure 102. In a preferred embodiment, the anti-helix structure 101 of FIGS. 11 and 12 comprises a half-dome, while the tragus structure 102 comprises a partial-dome wherein the base portion may be less than that of a half-dome, but the top portion may extend to or beyond the halfway point of a half-dome to provide increased coverage or enclosure of the microphone aperture 409 and other structures. Of course, in other variations, the top portion and bottom portion of the partial dome may vary in respective dimensions to form varying portions of a full dome structure, in order to create varying coverage of the microphone aperture 409. This allows the in-ear assembly 400 to produce different or enhanced acoustic input for calculating direction and distance of the source sound relative to the user. The antihelix structure 101 and the tragus structure 102 may be modular, such that different sizes or shapes (variations of different partial domes) may be swapped out based on a user's preference for particular acoustic characteristics.

In a preferred embodiment, as illustrated in FIGS. 10-13, a windscreen structure 418 may be disposed on the exterior surface of the secondary chamber 406 of the in-ear assembly 400. The windscreen structure 418 provides a mechanism to reduce unwanted noise and wind interference from the external environment, enhancing and filtering the quality of the incoming sound or audio input signal to be received by the in-ear assembly 400. Drawing your attention to FIGS. 10-13, the exterior surface of the secondary chamber 406 can comprise a plurality of windscreen attachment regions 424/424' to connect the windscreen structure 418, which comprises of a plurality of windscreen connectors 425/425', providing the ability to attach and remove the windscreen structure on the exterior of the in-ear assembly 400.

Figure 13:
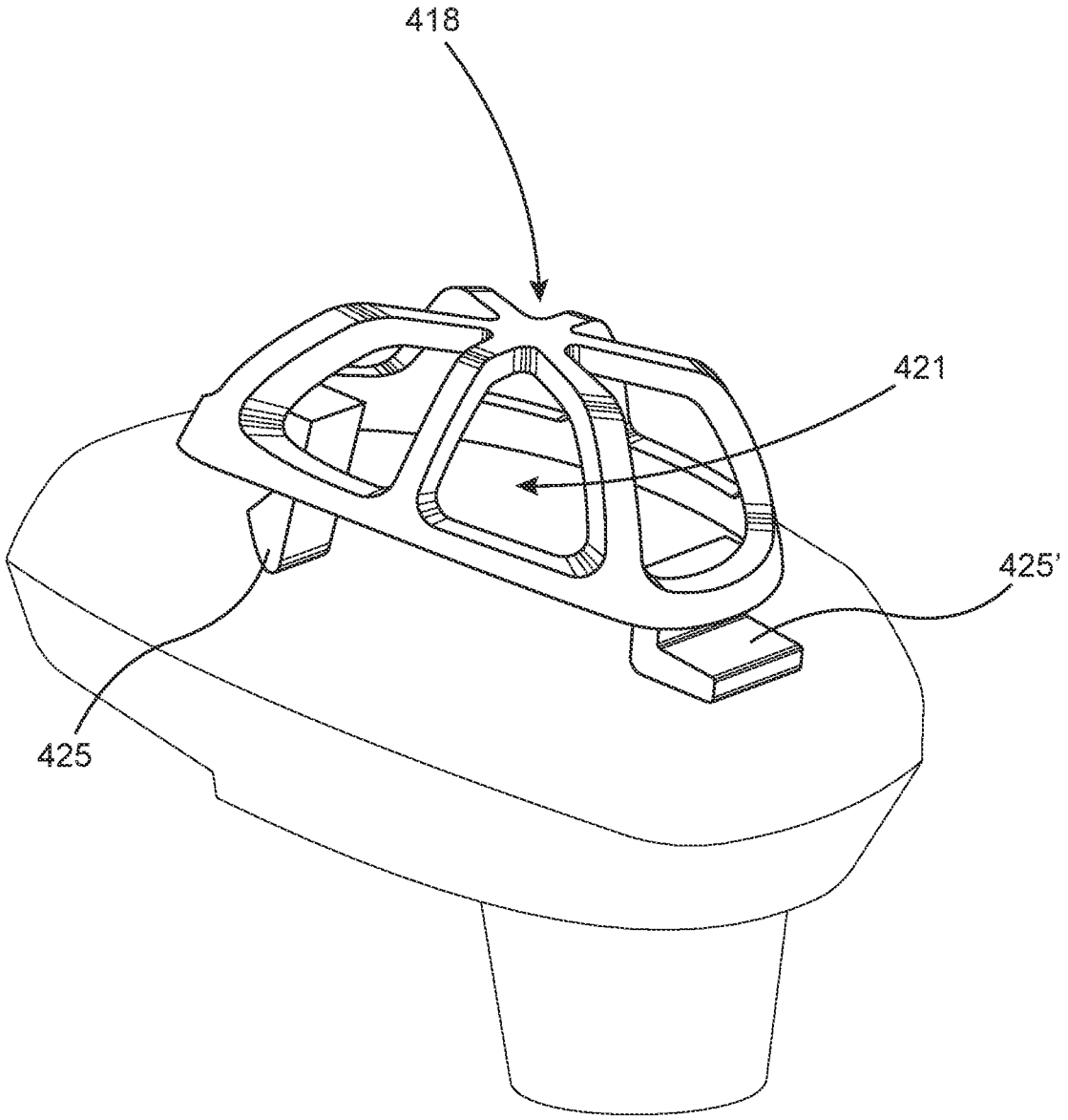
FIG. 13 is a perspective detail view of a portion of the embodiment of FIGS. 10 and 11.

As illustrated in FIG. 11 and FIG. 13, the windscreen structure 418 further comprises or houses an open-cell foam component 421, or a variety of other materials, which will together reduce noise interference from being received by the in-ear assembly 400. As such, in the preferred embodiment as depicted in FIG. 11, the windscreen structure 418 comprising the open-cell foam 421 can be disposed to partially or fully cover the antihelix structure 101, the tragus structure 102, and the microphone aperture 409. The windscreen structure 418 can be configured into variety of shapes. In one embodiment depicted in FIGS. 10 and 13, the windscreen structure 418 will take on a square shape with rounded edges, with an open-style hexagon like structure, providing a plurality of open slots, which may vary in number, such as six open slots. The open-cell foam 421 housed within can receive and filter noise disturbances, and transmit a higher quality sound to the antihelix structure 101, the tragus structure 102, the microphone aperture 409, down into the microphone channel 412, and into the microphone 415. The windscreen structure 418 can be made of a variety of materials, including a strong, flexible plastic, which can also provide protection to the underlying structures on the exterior of the in-ear assembly 400.

As illustrated in FIG. 11, the windscreen structure 418 comprises of windscreen connector structures 425 and 425', which snap into the windscreen attachment regions 424 and 424' on the exterior of the secondary chamber 406, and extend inside the secondary chamber 406 of the in-ear assembly 400. The windscreen attachment areas 424 and 424', and the windscreen connector structures 425 and 425' are sealed off and physically isolated from the microphone manifold 408, which comprises of microphone aperture 409, microphone channel 412, microphone 415, and microphone housing 416, as well as the playback module 230 and the other structures of inside the in-ear assembly 400. The isolation and sealed environment ensure that noise disturbances are reduced, and do not interfere with the audio input of the sound received by the microphone 415, and the output of sound transmitted by the playback module 230 to the user. Additionally, the windscreen structure 418 can be removed, allowing a user to replace the open-cell foam 421 with substitute materials as desired. Similarly, as depicted in FIG. 12, the antihelix structure 101 and the tragus structure 102 on the exterior of the secondary chamber 406 of the in-ear assembly 400 can be a removed and swapped out with different sizes and shapes of the antihelix structure 101 and tragus structure 102 to provide a user with different acoustic characters as desired.

Drawing attention now to FIG. 11, a microphone manifold 408 is an independent structure embedded within the in-ear assembly 400, comprising at least the microphone aperture 409, the microphone channel 412, the microphone 415, and the microphone housing 416. The microphone manifold 408 may reside wholly within the secondary chamber 406, or may also extend into the primary chamber 403. The microphone aperture 409 is exposed to the external environment, providing a means of receiving a sound signal or audio input, and is connected to and in air flow communication with, the microphone channel 412. The microphone channel 412 comprises a length that is at least two times its diameter. In one embodiment, the microphone channel 412 comprises a length that is three times its diameter. The microphone channel 412 is connected to the microphone 415, providing a means of communicating the sound signals and audio input received from the external environment to the microphone 415, which may be housed in a microphone housing 416. The microphone manifold 408 isolates the microphone channel 412 and the microphone 415 within the interior of the in-ear assembly 400, ensuring that the microphone 415 receives undisturbed sound and acoustic signals that funnel at least through the microphone aperture 409. As noted, the microphone 415 can also be housed within a microphone housing 416, further isolating the microphone 415 within the interior of the in-ear assembly 400.

The microphone channel 412 can be disposed in a substantially parallel orientation relative to the desired listening direction 104 of the user when the ear-in assembly 400 is worn by a user, generally illustrated in FIG. 10. In other embodiments, the microphone channel 412 can be disposed in a substantially perpendicular orientation relative to the listening direction 104 of the user. Similarly, the microphone 415 can be disposed in a substantially parallel orientation relative to the desired listening direction 104 of the user, or in a substantially perpendicular orientation when the in-ear assembly is worn by a user. However, the microphone channel 412 and microphone 415 can be disposed in various orientations, independent of the listening direction 104 of the user. The microphone 415 may be mounted flush on an end of the microphone manifold 408. In a preferred embodiment, an air cavity or gap 417 is situated between the microphone 415 and an end of the microphone manifold 408. Different gasses having different acoustic characteristics may be used with the air cavity.

Drawing attention to FIG. 11, the microphone 415 can be connected directly to the playback module 230, or speaker, housed within the primary chamber 403, or more generally in the interior of the in-ear assembly 400. The microphone 415 may be connected to the playback module 230 by means of a connective wire 430, or by a variety of means to allow communication between the microphone 415 and the playback module 230. The microphone 415 receives audio input from the external environment, which are communicated to the playback module 230, converting the audio input, into a sound or audio output that is relayed through the auditory channel 428, connected to an ear of the user, allowing the user to effectively determine the origination of the sound in three dimensional space.

Figure 14:
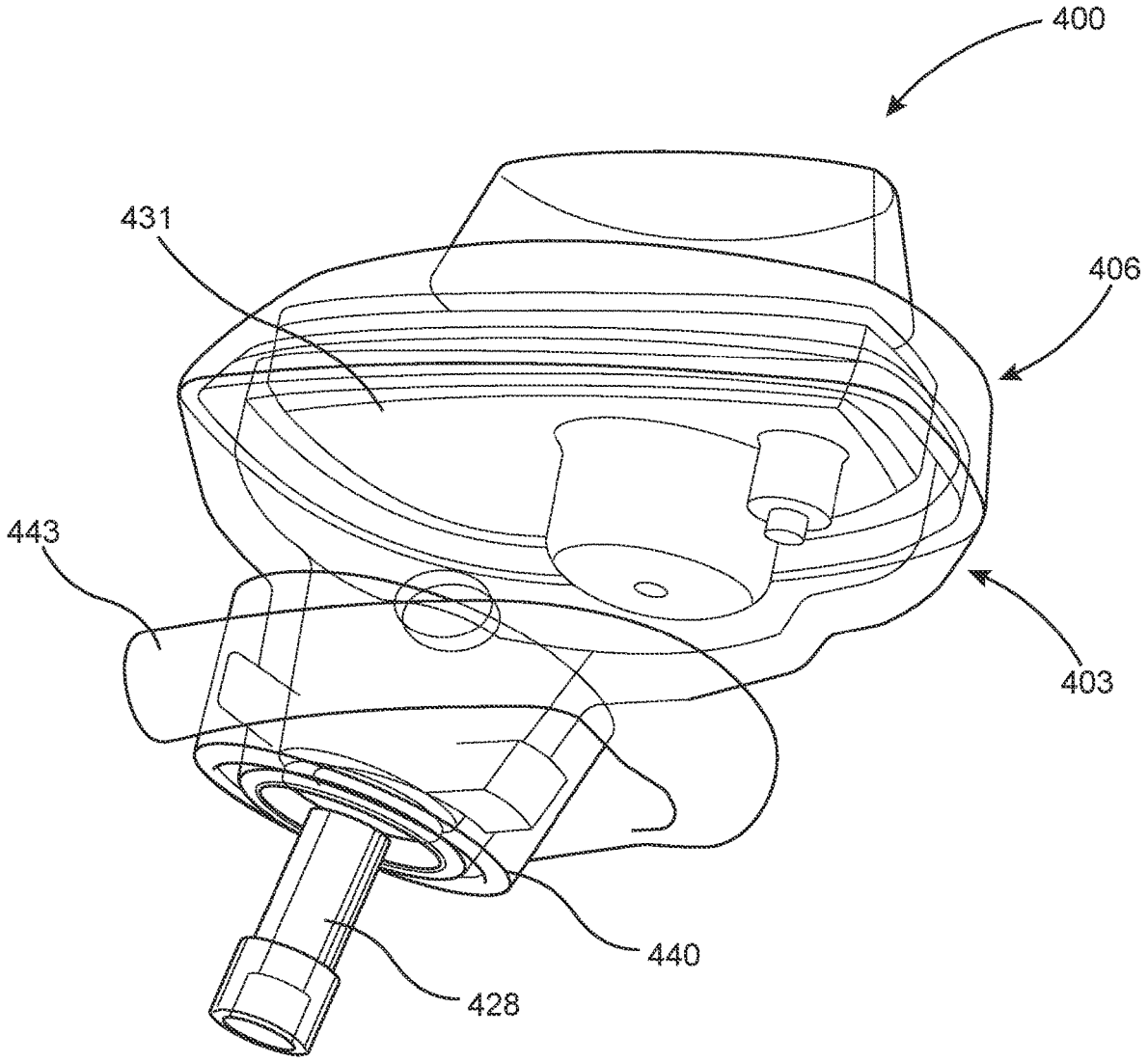
FIG. 14 illustrates a view of an isolation baffle disposed within an interior of the embodiment of FIGS. 10 and 11.

Drawing further attention to FIGS. 11 and 14, an isolation baffle 431 physically isolates the microphone 415 from the playback module 230 in order to prevent feedback noise during operation of the in-ear assembly 400. The isolation baffle 431 can achieve a 30 decibel or greater noise isolation between the microphone 415 and the playback module 230. The isolation baffle 431 achieves the goal of ensuring that the sound pressure or output of the playback module will not interfere with the microphone's 415 ability to effectively receive undisturbed sound input from the environment. The isolation baffle 431 allows a user to effectively receive undisturbed sound output from the playback module 230, allowing the user to effectively pinpoint the origination of sound from the external environment. As illustrated in FIGS. 11 and 14, the isolation baffle 431 can comprise of a single piece of a strong, flexible plastic. The isolation baffle 431 may transverse the length and width of the in-ear assembly 400, and connect to the inside surface of the top of the in-ear assembly 400, or specifically the inside surface of the secondary chamber 406. The isolation baffle 431 also comprises of an isolation post 434, that connects to a cylindrical structure 435 attached to the primary chamber 403 of the in-ear assembly 400, providing proper assembly and rigidity of the isolation baffle 431. In other embodiments, the isolation baffle 431 may comprise interconnecting units of a variety of materials to achieve the desired isolation between the microphone 415 and the playback module 230. The playback module 230 resides in the primary chamber 403 of the in-ear assembly 400, and the playback module 230. The playback module 230 is connected to an auditory channel 428, which resides in a user's ear, in the operative position, to communicate the audio output to the user. The playback module 230 converts the electrical audio input signal received from the microphone 415 and various structures, such as the preamplifier 210 and the audio processor 220, producing audio output data, which travels through the auditory channel 428 to the user. There may also be an air cavity 417' between the playback module 230 and the isolation baffle 431, providing the playback module with ample room to vibrate and produce different acoustic outputs.

Figure 15:
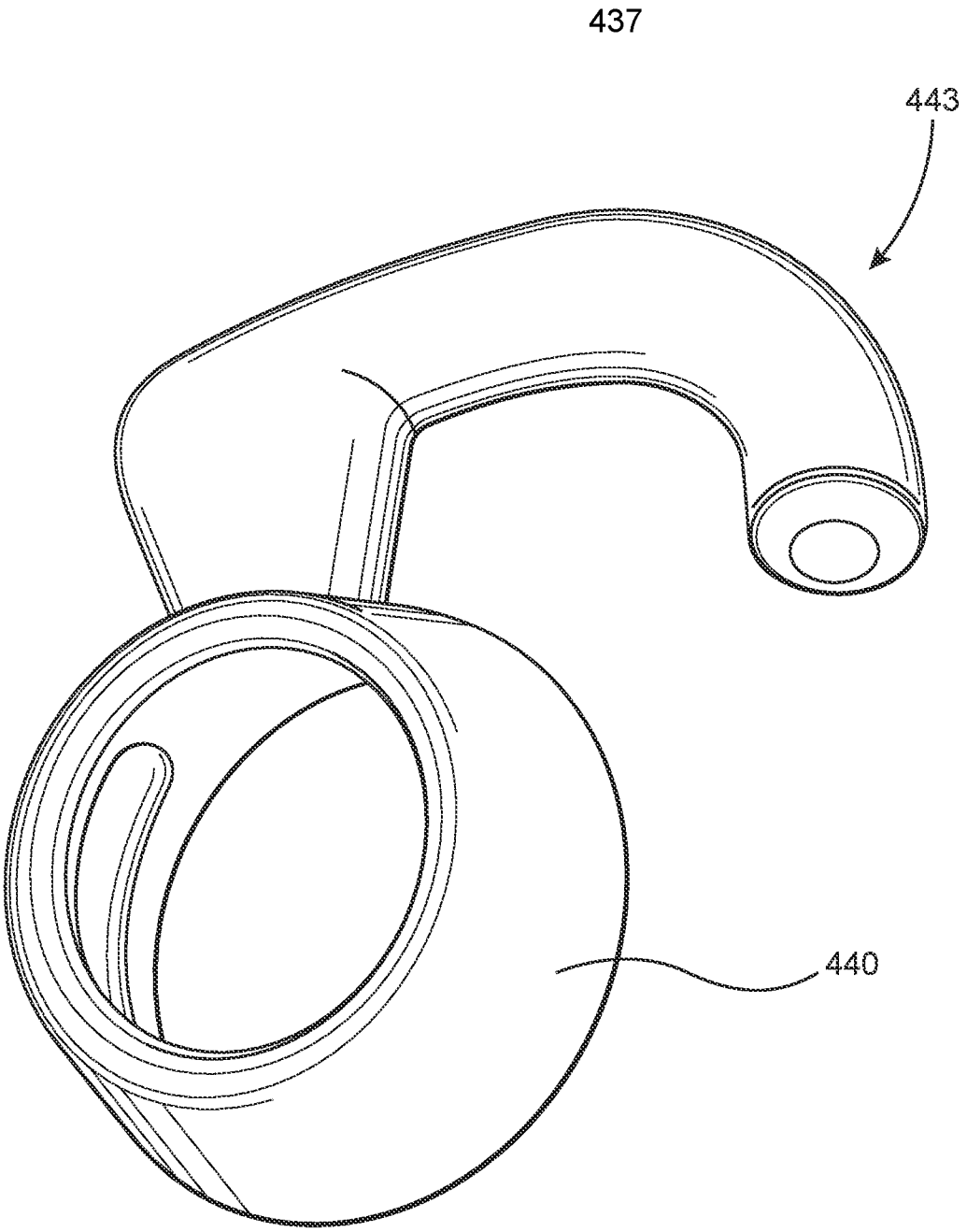
FIG. 15 illustrates a stabilizer assembly component to be disposed on an exterior of the embodiment of FIGS. 10 and 11.

Furthermore, as illustrated in FIGS. 10 and 15, a stabilizer assembly 437 can be attached to the exterior of the in-ear assembly 400, or the exterior of the primary chamber 403 of the in-ear assembly, to stabilize the in-ear assembly 400 and the various structures in the proper orientation, when in the user's ear, the operative position, as represented in FIG. 10. The stabilizer assembly 437, for example, ensures that the antihelix structure 101, tragus structure 102, and the other structures on the exterior of the secondary chamber 406 of the in-ear assembly 400 are facing the listening direction 104 of the user. In one preferred embodiment, the stabilizer assembly 437 provides the support to keep the microphone manifold 408 in a substantially parallel direction to the listening direction 104 of the user. As illustrated in FIG. 15, the stabilizer assembly 431 comprises a circular collar structure 440, which in the preferred embodiment is attached to an exterior portion of the primary chamber 403, and a concha-shaped structure 443 connected to the circular collar structure 440, that is situated comfortably within the outside portion of a user's ear. The stabilizer assembly 437 properly fixes the in-ear assembly 400 on a user's ear and restricts movement of the in-ear assembly to facilitate proper orientation.

In a preferred embodiment, the at least one in-ear assembly 400 also comprises the previously mentioned preamplifier 210 and audio processor 220, as schematically illustrated in FIG. 3. The preamplifier 210 can enhance the sound filtered through the in-ear assembly, enhancing certain acoustic characteristics to improve locational accuracy, or to further filter out unwanted noise. The preamplifier 210 may comprise an electronic amplifier, such as a voltage amplifier, current amplifier, transconductance amplifier, transresistance amplifier and/or any combination of circuits known to those skilled in the art for increasing or decreasing the gain of a sound or input signal. In at least one embodiment, the preamplifier comprises a microphone preamplifier configured to prepare a microphone signal to be processed by other processing modules. As it may be known in the art, microphone signals sometimes are too weak to be transmitted to other units, such as recording or playback devices with adequate quality. A microphone preamplifier thus increases a microphone signal to the line level by providing stable gain while preventing induced noise that might otherwise distort the signal.

The audio processor 220 may comprise a digital signal processor and amplifier, and may further comprise a volume control. Audio processor 220 may comprise a processor and combination of circuits structured to further enhance the audio quality of the signal coming from the microphone preamplifier, such as but not limited to shelf filters, equalizers, modulators. For example, in at least one embodiment the audio processor 220 may comprise a processor that performs the steps for processing a signal as taught by the present inventor's U.S. Pat. No. 8,160,274, the entire disclosure of which is incorporated herein by reference. Audio processor 220 may incorporate various acoustic profiles customized for a user and/or for an environment, such as those described in the present inventor's U.S. Pat. No. 8,565,449, the entire disclosure of which is incorporated herein by reference. Audio processor 220 may additionally incorporate processing suitable for high noise environments, such as those described in the present inventor's U.S. Pat. No. 8,462,963, the entire disclosure of which is incorporated herein by reference. Parameters of the audio processor 220 may be controlled and modified by a user via any means known to one skilled in the art, such as by a direct interface or a wireless communication interface.

Figure 16:
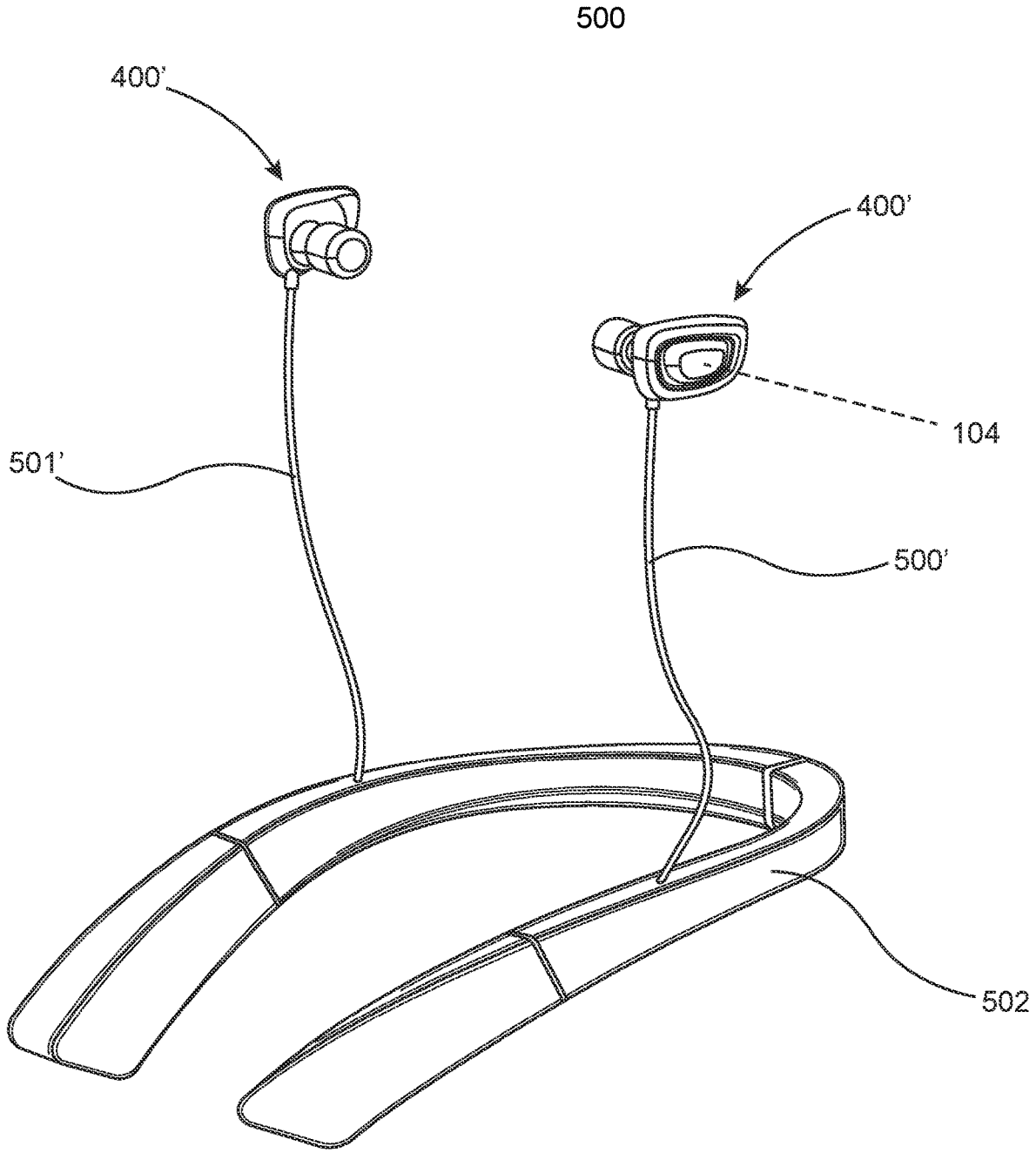
FIG. 16 illustrates an alternative embodiment of a wearable apparatus for hearing enhancement and protection capable of generating a head related audio transfer function for a user.
Figure 17A:
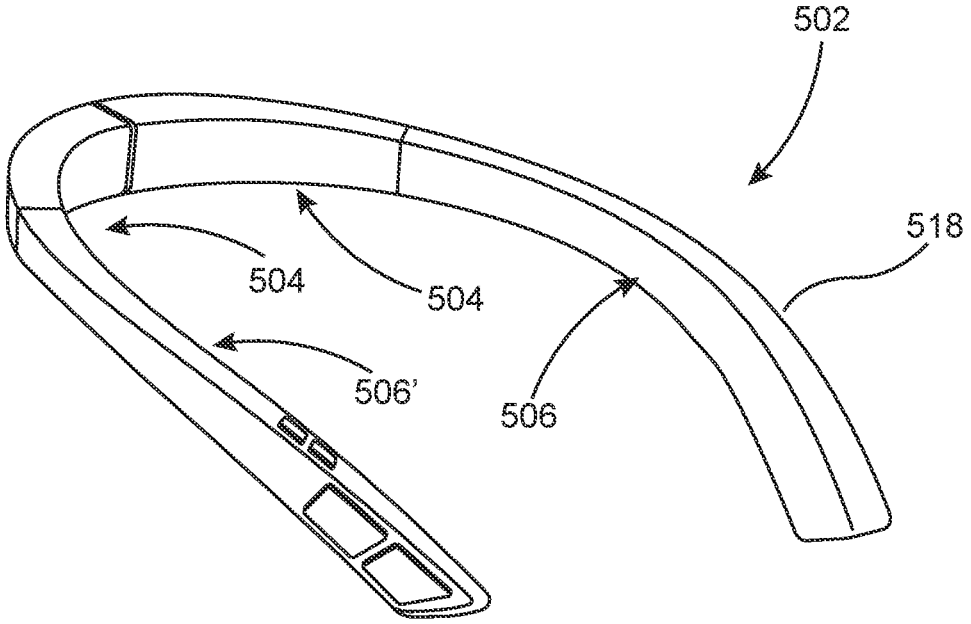
FIG. 17A illustrates an interconnecting member of the embodiment of FIG. 16.
Figure 17B:
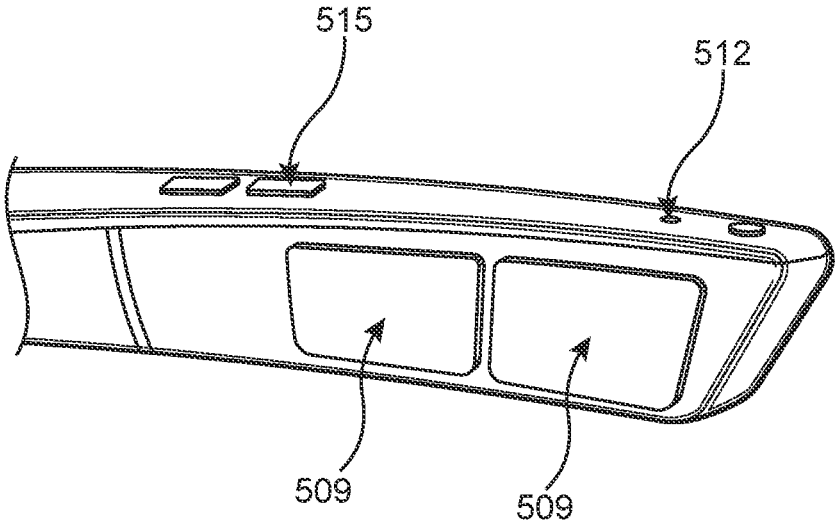
FIG. 17B illustrates a partially exploded view of an interconnecting member of the embodiment of FIG. 16.

In another embodiment as illustrated in FIG. 16, the at least one in-ear assembly 400 may form part of a larger wearable apparatus 500. The apparatus 500 comprises a left in-ear bud assembly 400, a right in-ear bud assembly 400', and an interconnecting member 502. A connective wire 501 can connect the left in-ear bud assembly 400 to the interconnecting member 502, and a connective wire 501' can connect the right in-ear bud assembly 400' to the interconnecting member 502. The interconnecting member 502 may comprise various components, as well as various amplifiers including but not limited to the preamplifiers 210/210', an audio processor 220, and playback modules such as 230/230', and other appropriate circuits or combinations thereof for receiving, transmitting, enhancing and reproducing sound. The interconnecting member 502, as illustrated in FIG. 17A, can comprise of a flexible back section 504 that wraps around or extends into a first side section 506 and a second side section 506', and may be worn by a user around his or her neck. Drawing attention to FIG. 17B, the interconnecting member 502 can comprise of a volume control function 509 to enhance or reduce the volume level received from the playback module 230, or to reduce the audio input received from the microphone 415. Additionally, the interconnecting member 502 can comprise of a call microphone function 512, providing a user the ability to make and receive calls without removing the wearable apparatus 500. The interconnecting member 502 can also comprise of a mute mode function 515 to prevent the transmission of audio output from the playback modules 230/230'. The interconnecting member 502 also comprises a removable battery 518, illustrated in FIG. 17A, capable of charging the apparatus. The interconnecting member 502 can be connected to the in-ear bus assemblies 400 and 400' by means of a connective wire as illustrated in FIG. 16, or a wireless connections, such as Bluetooth technology.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A wearable apparatus for hearing enhancement and protection capable of generating a head related audio transfer function for a user, said wearable apparatus comprising:

at least one in-ear assembly disposed in an operative position comprising:

a tragus structure on an exterior surface of said at least one in-ear assembly, an antihelix structure on said exterior surface of said at least one in-ear assembly, a microphone aperture on said exterior surface of said at least one in-ear assembly, said microphone aperture in air flow communication with an external environment, a microphone channel on an interior of said at least one in-ear assembly, said microphone channel in air flow communication with said microphone aperture, a microphone attached to an end of said microphone channel, a playback module connected to said microphone, an isolation baffle disposed to isolate said microphone from said playback module, an auditory channel connected to said playback module, said auditory channel disposed in communication with a user's ear to convey the head related audio transfer function, when in said operative position, and a preamplifier configured to receive an audio signal, an audio processor configured to receive an amplified signal, and said playback module configured to receive a processed signal.

2. The wearable apparatus as recited in claim 1 further comprising a windscreen structure on said exterior surface of said at least one in-ear assembly.

3. The wearable apparatus as recited in claim 2 wherein said windscreen structure is disposed to partially enclose said microphone aperture, said tragus structure, and said antihelix structure.

4. The wearable apparatus as recited in claim 1 wherein said tragus structure is disposed to partially enclose said microphone aperture.

5. The wearable apparatus as recited in claim 1 wherein said antihelix structure is disposed to partially enclose said tragus structure and said microphone aperture.

6. The wearable apparatus as recited in claim 1 wherein said microphone channel comprises a length that is at least two times its diameter.

7. The wearable apparatus as recited in claim 1 wherein said isolation baffle achieves at least a 30 decibel noise isolation between said microphone and said playback module.

8. The wearable apparatus as recited in claim 1 wherein said microphone channel and said microphone are in a substantially parallel orientation relative to a listening direction of said user.

9. The wearable apparatus as recited in claim 1 further comprising a stabilizer assembly connected to said exterior of said at least one in-ear assembly.

10. The wearable apparatus as recited in claim 9 wherein said stabilizer assembly comprises a circular collar attached to said exterior of said at least one in-ear assembly, and a concha-shaped structure attached to said circular collar and structured for disposition on a user's ear when in said operative position.

11. A wearable apparatus for hearing enhancement and protection capable of generating a head related audio transfer function for a user, said wearable apparatus comprising:

a left in-ear assembly and a right in-ear assembly disposable in an operative position, said left in-ear assembly and said right in-ear assembly each comprise of a primary chamber and a secondary chamber, said primary chamber disposed proximal to a user's ear and said secondary chamber disposed distal to a user's ear, when in said operative position, said secondary chamber comprises:

a microphone aperture on an exterior surface of said secondary chamber, said microphone aperture in air flow communication with an external environment;

a tragus structure on said exterior surface of said secondary chamber, said tragus structure disposed to partially enclose said microphone aperture, an antihelix structure on said exterior surface of said secondary chamber, said antihelix disposed to partially enclose said tragus structure and said microphone aperture, a microphone channel on an interior of said secondary chamber, said microphone channel in air flow communication with said microphone aperture, a microphone disposed within an end of said microphone channel, said primary chamber comprises:

a playback module connected to said microphone, an auditory channel connected to said playback module, said auditory channel disposed in communication with a user's ear to convey the head related audio transfer function, when in said operative position, an isolation baffle disposed to isolate said microphone from said playback module, and a preamplifier configured to receive an audio signal, an audio processor configured to receive an amplified signal, and said playback module configured to receive a processed signal.

12. The wearable apparatus as recited in claim 11 further comprising a windscreen structure on said exterior surface of said secondary chamber.

13. The wearable apparatus as recited in claim 12 wherein said windscreen structure is disposed to partially enclose said microphone aperture, said tragus structure, and said antihelix structure.

14. The wearable apparatus as recited in claim 11 wherein said microphone channel comprises a length that is at least two times its diameter.

15. The wearable apparatus as recited in claim 11 wherein said isolation baffle achieves at least a 30 decibel noise isolation between said microphone and said playback module.

16. The wearable apparatus as recited in claim 11 wherein said microphone channel and said microphone are in a substantially parallel orientation relative to a listening direction of said user.

17. The wearable apparatus as recited in claim 11 further comprising a stabilizer assembly, said stabilizer comprising a circular collar connected to said exterior of said primary chamber, and a concha-shaped structure disposed on a user's ear, when in said operative position.

18. A wearable apparatus for hearing enhancement and protection capable of generating a head related audio transfer function for a user, said wearable apparatus comprising:

at least one in-ear assembly disposable in an operative position, said at least one in-ear assembly comprising a primary chamber and a secondary chamber, said primary chamber disposed proximal to a user's ear and said secondary chamber disposed distal to a user's ear, when in said operative position, and an interconnecting member connected to said at least one in-ear assembly, said secondary chamber including:

a microphone aperture on an exterior surface of said secondary chamber, said microphone aperture in air flow communication with the external environment;

a tragus structure on said exterior surface of said secondary chamber, said tragus structure disposed to partially enclose said microphone aperture, an antihelix structure on said exterior surface of said secondary chamber, said antihelix disposed to partially enclose said tragus structure and said microphone aperture, a microphone channel on an interior of said secondary chamber, said microphone channel in air flow communication with said microphone aperture, a microphone attached to an end of said microphone channel, an isolation baffle disposed to isolate said microphone from a playback module;

said primary chamber including:

a playback module connected to said microphone, said playback module isolated from said microphone, an auditory channel connected to said playback module, said auditory channel disposed in communication with a user's ear to convey the head related audio transfer function, when in an operative position, a stabilizer assembly, said stabilizer comprising a circular collar connected to said exterior of said primary chamber, and a concha-shaped structure attached to said circular collar and structure for disposition on a user's ear, when in an operative position, said interconnecting member including:

a flexible back section connected to a side section on one end and a side section on a second end, said interconnecting member connected to said at least one in-ear assembly, at least one audio processor configured to receive an audio signal from said at least one in-ear assembly, and at least one preamplifier configured to receive said audio signal, said audio processor further configured to receive an amplified signal, and said playback module configured to receive a processed signal.

19. The wearable apparatus as recited in claim 18 wherein said microphone channel and said microphone are in a substantially parallel orientation relative to a listening direction of a user.

20. The wearable apparatus as recited in claim 18 wherein said isolation baffle achieves at least a 30 decibel noise isolation between said microphone and said playback module.

21. The wearable apparatus as recited in claim 18 further comprising a windscreen structure on said exterior surface of said at least one in-ear assembly, disposed to partially enclose said microphone aperture, said tragus structure, and said antihelix structure.

* * * * *